US012276193B2

(12) United States Patent
Volkers et al.

(10) Patent No.: US 12,276,193 B2
(45) Date of Patent: Apr. 15, 2025

(54) UNDERGROUND DRILLING RIG AND METHOD FOR ERECTING SAME

(71) Applicant: BENTEC GMBH DRILLING & OILFIELD SYSTEMS, Bad Bentheim (DE)

(72) Inventors: Jürgen Volkers, Bad Bentheim (DE); Arend Lödden, Bad Bentheim (DE); Achim Nordbeck, Bad Bentheim (DE)

(73) Assignee: BENTEC GMBH DRILLING & OILFIELD SYSTEMS, Bad Bentheim (DE)

( * ) Notice: Subject to any disclaimer, the term of this patent is extended or adjusted under 35 U.S.C. 154(b) by 267 days.

(21) Appl. No.: 17/633,574

(22) PCT Filed: Aug. 10, 2020

(86) PCT No.: PCT/EP2020/072381

§ 371 (c)(1),
(2) Date: Feb. 7, 2022

(87) PCT Pub. No.: WO2021/028383

PCT Pub. Date: Feb. 18, 2021

(65) Prior Publication Data

US 2022/0307373 A1 Sep. 29, 2022

(30) Foreign Application Priority Data

Aug. 13, 2019 (DE) ..... 10 2019 212 152.7

(51) Int. Cl.

| | |
|---|---|
| ***E21C 41/16*** | (2006.01) |
| ***E21B 7/04*** | (2006.01) |
| ***E21B 15/00*** | (2006.01) |

(52) U.S. Cl.
CPC ..... *E21C 41/16* (2013.01); *E21B 7/04* (2013.01); *E21B 15/00* (2013.01)

(58) Field of Classification Search
CPC ..... E21C 41/16; E21B 7/04; E21B 15/00
See application file for complete search history.

(56) References Cited

U.S. PATENT DOCUMENTS

| | | | | |
|---|---|---|---|---|
| 2,331,072 | A | 10/1943 | Hansen et al. | |
| 2,989,294 | A | 6/1961 | Coker | |
| 4,436,455 | A * | 3/1984 | Vance | E21B 7/025 173/195 |
| 8,353,132 | B1 | 1/2013 | Vogt et al. | |
| 2011/0220413 | A1 | 9/2011 | Suhm et al. | |
| 2017/0016325 | A1* | 1/2017 | Kouhia | E21C 39/00 |

FOREIGN PATENT DOCUMENTS

| | | |
|---|---|---|
| DE | 102008006392 | 7/2009 |
| EP | 2245256 | 11/2010 |

* cited by examiner

*Primary Examiner* — Dany E Akakpo
(74) *Attorney, Agent, or Firm* — LIU & LIU

(57) ABSTRACT

The Invention relates to an underground drilling rig (10) and a method for its erection, wherein the method, in a special embodiment, comprises erecting a mast structure (20) of the drilling rig (10) extending from a horizontal tunnel (production tunnel) into a vertical mast shaft (14) and by means of an erecting structure (50), wherein the mast structure (20) comprises a plurality of mast segments (60) connected to one another or connectable to one another.

17 Claims, 17 Drawing Sheets

UNDERGROUND DRILLING RIG AND METHOD FOR ERECTING SAME

BACKGROUND OF THE INVENTION

1. Field of the Invention

The invention relates to a drilling rig referred to as an underground drilling rig, erected underground and operated underground as well as to a method for its erection.

2. Description of Related Art

Drilling rings, namely drilling rings for sinking deep boreholes on hydrocarbon deposits or for developing geothermal energy are in principle known per se. Such drilling rigs are conventionally designed as land drilling rigs or as so-called offshore drilling rigs. From U.S. Pat. No. 2,331,072 and EP 2 245 256 A1 a method and an apparatus for sinking a deep borehole underground are known. An operation of a drilling rig underground has the advantage that the drilling rig does not appear visually or acoustically above ground and the drilling rig does not need any space above ground. In an especially preferred embodiment, no structural measures are required above ground for erecting the drilling rig at the position of the deep borehole.

To erect the underground drilling rig, sometimes referred to in short below as a drilling rig, underground, a tunnel is driven into the rock mass. The expression "rock mass" is to be understood within the meaning of so-called mining terminology and refers to the material of the earth's crust, in particular rock, into which mines (shafts, tunnels, etc.) are driven. The tunnel driven into the rock mass for the erection of the drilling rig comprises at least one horizontal section or at least substantially horizontal section. This is referred to below as a production tunnel. A vertical shaft extends from this production tunnel. This is referred to below as the mast shaft. The mast shaft is preferably, but not necessarily a blind shaft, a shaft that does not extend to the surface. The erection of the drilling rig takes place in the production tunnel and below the mast shaft and in part into the mast shaft. The production tunnel and the mast shaft as well as their construction are not the subject matter of the innovation presented here.

SUMMARY OF THE INVENTION

The innovation is a method for erecting a drilling rig (underground drilling rig) in such a production tunnel and in the area of a mast shaft there and a drilling rig (underground drilling rig) erected according to the method.

The present method is a method for erecting a drilling rig (underground drilling rig) for sinking deep boreholes referred to sometimes below in short as boreholes, namely deep boreholes on hydrocarbon deposits or for developing geothermal energy or other valuable materials or deep boreholes for research purposes, in a tunnel driven, for example, by means of a tunnel boring machine into a rock mass. The tunnel comprises a horizontal or at least substantially horizontal section. This is referred to here and below as a production tunnel, in order to distinguish it. The production tunnel or at least a section of the production tunnel functions as a production line when erecting the drilling rig or when the drilling operation is later carried out. The terms "horizontal section of the tunnel", "production tunnel" and "production line" refer to the same thing. A vertical section/a vertical shaft extends from the production tunnel. This is referred to here and below and to distinguish it from the production tunnel as the mast shaft.

It should already now be pointed out that in the description and claims presented here terms and directions such as "horizontal", "vertical", "parallel", "aligned" and the like are always to be read as "horizontal or at least substantially horizontal", "vertical or at least substantially vertical" and so on. The innovation proposed here does not depend on an exactly horizontal or an exactly vertical orientation or an exactly parallel or an exactly aligned orientation and so on. Therefore, even only approximately horizontal, vertical, parallel, aligned and so on alignments or orientations are sufficient. In the interest of a better readability of the following description, said description proceeds with brief direction and orientation information, namely "horizontal", "vertical", "parallel" and the like, wherein the general form formulated above is always meant and is to be read accordingly.

The erection of the drilling rig (underground drilling ring) according to the approach proposed here takes place in the production tunnel and in the area of the mast shaft there. When the drilling rig is operated, the handling of the drill pipe elements, which is in principle known per se, takes place in the mast shaft. Handling the drill pipe elements includes connecting the drill pipe elements to the drill string during the so-called installation of a drill string and releasing drill pipe elements from the drill string during the so-called removal of a drill string. The drilling operation of the drilling rig occurs underground in principle in the manner known from land drill rigs or offshore drill rings and accordingly requires no further description here. For a general orientation, it should be noted that the raising or lowering of the drill string in the borehole is effected in the mast shaft underground and that a longitudinal axis of the drill string above the floor level of the production tunnel is parallel or at least substantially parallel to the vertical axis of the mast shaft.

The method proposed here for erecting or when erecting the drilling rig (underground drilling rig) comprises at least the following method steps in one variant:

- raising a crown bearing of the drilling rig from the production tunnel and into the mast shaft and
- vertically fixing the crown bearing in the mast shaft at a distance from a ceiling of the production tunnel,
- wherein the distance corresponds to at least the length of at least one drill pipe of the drilling rig.

This variant relates to a drilling rig (underground drilling rig), in which the raising and lowering of the drill string takes place by means of a hoisting apparatus and a pulley system belonging to the drilling rig. In a drilling rig, the pulley system includes a crown bearing and a crown block there as well as a block, which is suspended under the crown block and vertically movable, the so-called traveling block. The crown block and the traveling block function as the upper block and lower block of the pulley system. In a corresponding variant, this also applies to the drilling rig (underground drilling rig) proposed here. The drill string hangs directly or indirectly from the lower block. The crown bearing must be located at a certain height above the so-called drill floor, so that the usual handling of drill rods or drill pipe hoists—here and in the following referred to collectively as drill pipe element or drill pipe elements—is possible when installing and removing the drill string. With a functional indication of the height of the crown bearing above the drill floor, this can be related to the drill pipe elements provided for use during the drilling operation, namely, an individual drill pipe (so-called single) or drill pipe combined to form drill pipe hoists (so-called doubles, triples, etc.): Accordingly, the distance (height) of the crown bearing from the drill floor is at least so great that in each case one of the drill pipe elements provided for use in the drilling rig, the respective drive device for rotating the drill string (drill string drive unit), in the case of a drilling rig with a so-called top drive therefore the top drive, and the pulley system are accommodated between the drill floor and crown bearing. In fact, the distance is greater by a margin of safety and movement (a measure of safety and movement) in order to enable a mobility of the units mentioned above the drill floor. These conditions (necessary distance of the crown bearing from the drill floor) also apply in the case of the drilling rig (underground drilling rig) proposed here. In the case of previous drilling rigs (land drilling rig, offshore drilling rig) the necessary height of the crown bearing is achieved by means of a drilling mast (derrick). The drilling mast also absorbs the forces (weight of the drill string), which act on the crown bearing during the drilling and the drilling mast directs the forces occurring indirectly or directly into the ground in the area of the drilling rig. In the case of an underground drilling rig, additional possibilities result for dissipating these forces. In the case of an underground drilling rig—as in the case of previous drilling rigs—a drilling mast (or derrick) can be used to dissipate these forces. The drilling mast (referred to below as the mast structure) is then erected in the mast shaft and in principle the same conditions as in previous drilling rigs result. However, wind loads and the like, for example, do not need to be taken into account, so that in the case of the underground drilling rig, the drilling mast can be designed to be statically correspondingly simpler. Since the drilling mast can be supported along the mast shaft, an operation with longer drill pipe hoists (four-times or five-times as long hoists) is possible. Thus, a reduction of the so-called setback area is advantageously possible. A reduction of the setback area is especially advantageous in a narrow mast shaft. Longer drill pipe hoists are also advantageous for the so-called trip speed. However, it is essential that in the case of an underground drilling rig the possibility exists for the first time to do without a drilling mast for absorbing the forces acting on the crown bearing. For this purpose, the crown bearing is fixed, for example, in the mast shaft itself, namely in principle at the same height as in a use of a drilling mast, and reference is made to the above statements with regard to the necessary distance of the crown bearing from the drill floor (height of the crown bearing above the drill floor). The dissipation of the forces acting on the crown bearing takes place in the case of such an attachment in the mast shaft into the mast shaft wall and the surrounding rock mass; the mast shaft functions to a certain extent as a drilling mast. Another possibility consists in suspending the crown bearing to a certain extent in the mast shaft. Then the forces acting on the crown bearing are absorbed by the suspension of the crown bearing. The suspension (at least a steel cable or the like) thereby extends from the crown bearing to the surface (above ground) and the suspension can thereby, for example, lead through a ventilation shaft or the like extending from the mast shaft. The suspension ends, for example, above ground in a foundation there. Alternatively, the crown bearing can also be hung from the ceiling of the mast shaft.

Each of the two outlined variants (fixing the crown bearing in the mast shaft to dissipate the forces into the mast shaft wall; suspending the crown bearing in the mast shaft and absorbing the forces by the suspension of the crown bearing) belongs—as in principle an optional partial aspect—to the innovation proposed here. Both variants can also be combined and such a combination also belongs—as in principle an optional partial aspect—to the innovation proposed here.

In the method outlined above, which is proposed here, for erecting a drilling rig (underground drilling rig), the attachment of the crown bearing at the necessary height, therefore at a necessary distance from the drill floor of an already existing or, if applicable, subsequently erected substructure of the drilling rig, is in the foreground. Due to the possibilities also outlined above of attaching the crown bearing even without a drilling mast, the possible erection of a drilling mast takes a back seat and the erection of a drilling mast is only optional. In the event of the erection of a drilling mast this takes place preferably together with the raising of the crown bearing in the mast shaft or as a subsequent method step after the raising of the crown bearing in the mast shaft.

In the proposed method, the crown bearing is raised from the production tunnel into the mast shaft. When the necessary height is reached (necessary distance from the drill floor as described above) the crown bearing is fixed in the mast shaft. The fixation is at least a vertical fixation (fixation in the direction of the vertical axis of the mast shaft). The vertical fixation takes place at a distance from a ceiling of the production tunnel. This distance corresponds to at least the length of at least one drill pipe of the drilling rig.

The distance related to the ceiling of the production tunnel, therefore the height of the crown bearing in the mast shaft related to the ceiling of the production tunnel, is a definition of the height without reference to the drill floor of the drilling rig, which may be installed later. The plane of the drill floor will lie in the production tunnel between the floor level of the production tunnel and its ceiling. When installing and removing the drill string, in each case at least one drill pipe is moved, i.e. connected to the drill string or released from the drill string, both in each case with a vertical orientation of the at least one drill pipe. Even with a drill floor significantly below the ceiling of the production tunnel, the definition of the distance of the crown bearing from the ceiling of the production tunnel (the height of the crown bearing above the ceiling of the production tunnel) with reference to the length of at least one drill pipe of the drilling rig is correct, because the height corresponds at least to the length of at least one drill pipe. According to the definition, the height can also be greater than the length of exactly one drill pipe, for example, if so-called doubles (two drill pipes; a drill pipe hoist comprising two drill pipes) or triples (three drill pipes; a drill pipe hoist comprising three drill pipes) etc. (drill pipe hoists with more than three drill pipes) are provided. However, the height can also be greater than the length of at least one drill pipe for the reason that space remains for a pulley system and, for example, a top drive. This required additional vertical height of the crown bearing beyond the height required due to the length of the at least one drill pipe is taken into account by the definition of the distance from the ceiling of the production tunnel (height of the crown bearing above the ceiling of the production tunnel) with the word "at least"— "at least the length [ . . . ] of a drill pipe". An exact definition of the required height of the crown bearing (either above the ceiling of the production tunnel or above the level of the drill floor) is not possible for any variant of an underground drilling rig and the specific height depends, for example, on whether a top drive or another drill string drive unit is used to rotate the drill string, how great the minimum distance is between the upper block (crown bearing/crown block) and the lower block (traveling block) of the pulley system, on which, for example, the top drive is suspended, and so on.

The crown bearing in the mast shaft can be raised, for example, with cables guided in the mast shaft and in a ventilation shaft connected to the mast shaft and a hoist apparatus placed above ground or another pulling or lifting unit. Alternatively, in principle optional possibilities for raising the crown bearing in the mast shaft are described further below.

In one embodiment of the method, it is provided that before the method step of raising the crown bearing in the mast shaft said method also comprises the method step of erecting an erecting structure in the production tunnel and below the mast shaft. The crown bearing is then raised starting from the erecting structure and into the mast shaft. The erecting structure creates defined and safe conditions for the positioning of the crown bearing before raising and during raising.

The advantage of the proposed innovation consists in the basic possibility of the erection of a drilling rig underground and the simple possibility of an erection of such a drilling rig by placing the crown bearing of the drilling rig in the vertical mast shaft extending from the production tunnel. Following the raising and fixing of the crown bearing in the mast shaft proposed here, the erection of the drilling rig is continued with the method steps substantially known in principle per se (from land drilling rigs or offshore drilling rigs).

It was pointed out above that a pulley system in a drilling rig (underground drilling rig) is only one way of raising and lowering the drill string. Another variant of the method proposed here for erecting a drilling rig (underground drilling rig) relates to a drilling rig, in which the drill string is raised and lowered without a hoist apparatus and pulley system. Then a drive device for rotating the drill string (drill string drive unit), therefore, for example, a top drive, is moved vertically by means of a drive device and/or a lifting device. A rack and pinion drive or an electromagnetic linear drive, for example, can be considered as the drive device for the vertical movement of the drill string drive unit. A hydraulic cylinder, in particular, a telescopic hydraulic cylinder, can be considered as the lifting device for the vertical movement of the drill string drive unit. Such drive or lifting devices as well as the sequences of movements resulting from the drilling operation during the vertical movement of the respective drill string drive unit are known per se, so that no further explanation is necessary here and reference is made to the prior art.

Because such a drilling rig (underground drilling rig) without a pulley system does not require a crown bearing, the method for erecting such a drilling rig underground cannot be defined with reference to a crown bearing. In the case of such a drilling rig intended to sink deep boreholes of the type mentioned above, the method for their erection in a tunnel driven into a rock mass, which comprises a horizontal section functioning as a production tunnel and a production line, from which a vertical section extends as a mast shaft, is characterized in that by means of an erecting structure in the production tunnel and starting from the production tunnel a mast structure (drilling mast structure) is erected in the mast shaft and from the production tunnel into the mast shaft (therefore, so to speak "from bottom to top"), and that the mast structure comprises a plurality of mast segments erectable/erected successively by means of the erecting structure. The erecting structure is located in the production tunnel and is erected there—in an introductory method step that is optionally part of the method proposed here—for example, on the floor level of the production tunnel. The mast structure comprises the plurality of mast segments as mast segments which are connected to one another or can be connected to one another. In the case of mast segments that are connected to one another, these are already connected to one another when the mast structure is erected, for example, connected to one another in an articulated manner. In the case of mast segments that can be connected to one another, these are connected to one another at the latest after the mast structure has been erected. The mast structure functions as a guide and as a torque support for a drill rod drive unit, therefore, for example, for a top drive.

The mast structure can carry a crown bearing in an in principle optional manner. The crown bearing, the crown block there and the so-called traveling block and the pulley system formed with it then function as a lifting device for the respective drill string drive unit. In a corresponding, in principle optional, advantageous embodiment of a method for erecting a drilling rig (underground drilling rig) with such a mast structure and by means of an erecting structure, it is provided that, as part of the method, on the one hand, the raising of the crown bearing in the mast shaft and the vertical fixing of the crown bearing as well as, on the other hand, the erection of the mast structure takes place in the mast shaft. The crown bearing can be raised in the course of erecting the mast structure and by means of the mast structure in such a way that the mast structure carries the crown bearing and the crown bearing is also raised when the mast structure is raised into the mast shaft. The raising of the crown bearing and the raising of the mast structure into the mast shaft can also be carried out independently of one another. Then the crown bearing is first raised in the mast shaft and fixed vertically there and then the mast structure is raised into the mast shaft. The crown bearing and the mast structure can then be connected to one another. If the crown bearing is raised by means of the mast structure and is thus connected to the mast structure from the start or if the crown bearing is raised in the mast shaft independently of the mast structure and the crown bearing is only connected to the mast structure after the mast structure has been erected, the connection of the crown bearing and mast structure results, in any case, in the mast structure absorbing at least part of the forces later acting on the crown bearing during drilling. In addition, the mast structure functions as a guide and/or as a torque support for the respective drill string drive unit. The crown bearing and the mast structure can also remain independent of one another, so that—as described above—the forces acting on the crown bearing during the drilling operation are dissipated, for example, into the wall of the mast shaft. The mast structure then essentially only functions as a guide and/or as a torque support for the respective drill string drive unit.

Here, too, the advantage of the proposed innovation is the basic possibility of erecting a drilling rig underground and the simple possibility of erecting such a drilling rig by erecting a mast structure comprising several mast segments in the vertical mast shaft extending from the production tunnel. Here, too, following the erection of the mast structure in the mast shaft proposed here, the erection of the drilling rig is continued with method steps substantially known in principle per se (from land drilling rigs or offshore drilling rigs).

Advantageous embodiments of the invention are the subject of dependent claims. In this regard, back references used within the claims indicate further formation of the subject matter of the referenced claim by the features of the respective dependent claim. They are not to be understood as a waiver of obtaining independent protection for the features or feature combinations of a dependent claim. Furthermore, with regard to an interpretation of the claims, it is to be assumed that in the case of a more detailed specification of a feature in a dependent claim that such a limitation is not present in the respective preceding claims. Finally, it should be pointed out that the method specified here can also be further developed in accordance with the dependent device claims, and vice versa.

Since the subjects of the dependent claims can form their own and independent inventions with regard to the prior art on the priority date, the applicant reserves the right to make them the subject matter of independent claims or divisional applications. They can also contain independent inventions that have a configuration that is independent of the subjects of the preceding dependent claims.

In a special embodiment of a method for erecting a drilling rig (underground drilling rig) underground, which also comprises the erection of a mast structure, it is provided that the erecting structure on an input side of the erecting structure is successively fed mast segments in a horizontal orientation, that by means of the erecting structure in the area of an output side of the erecting structure, in each case at least one mast segment is erected in a vertical orientation into the mast shaft or at least pointing into the mast shaft and that when further mast segments are fed in on the input side, the or each already vertically erected mast segment is raised into the mast shaft on the output side.

The number of mast segments successively fed in overall at the input side naturally depends on the desired height of the mast structure and if the height of a mast structure is for a drilling rig, for example, six mast segments are successively fed to the erecting structure, and if the height of the mast structure is for another drilling rig, for example, eight or nine mast segments are fed to the erecting structure. The numerical values mentioned are expressly to be understood only as examples.

A first mast segment fed to the erecting structure is erected by means of the erecting structure and initially remains in the erected alignment in/on the erecting structure. A second mast segment fed to the erecting structure comes into contact with the first, already erected mast segment at latest when erecting and to a certain extent displaces it from its previous position. This displacement results in the first, already vertically erected mast segment being raised into the mast shaft. This is repeated during the successive feeding of further mast segments and in the course of their erection by means of the erecting structure.

In a first variant of this embodiment of the method, to a certain extent a mast segment newly fed to the erecting structure pushes all the mast segments previously fed to the erecting structure in front of it in the erecting structure and causes them to be raised into the mast shaft—if they are already erected. For this purpose, a drive device is provided which temporarily engages that mast segment, which pushes all other mast segments previously fed to the erecting structure in front of it. The erecting structure thereby functions as a guide of the or each mast segment or for the or each mast segment and functions for the mast segments like a rail system or in the manner of a rail system. The process is repeated until all mast segments have been raised into the mast shaft.

The drive device can have a pushing effect and is then realized, for example, in the form of a hydraulic or pneumatic cylinder. Realization with a rack and pinion drive or the like can also be considered. The drive device can alternatively have a pulling effect. A realization of the drive device in the form of a hydraulic or pneumatic cylinder, a rack and pinion drive, a pulley system or the like can then also be considered.

In a second variant of this embodiment of the method, the or each mast segment that has already been erected by means of the erecting structure is raised by means of a lifting device. For example, a hydraulic or pneumatic cylinder, a rack and pinion drive, a pulley system or the like functions as the lifting device. The lifting device engages the mast segment erected by means of the erecting structure or the last mast segment erected by means of the erecting structure. In the first case, the lifting device lifts this mast segment. In the latter case, the lifting device lifts a plurality of mast segments, namely all mast segments erected by means of the erecting structure.

The raising by means of the lifting device takes place until there is space below the or each mast segment raised in this way for the erection of a further mast segment by means of the erecting structure. Then the newly erected mast segment is fixed in the erecting structure. This connects, for example, directly to the or each previously raised mast segment and carries it in the fixed configuration and by means of the erecting structure. The lifting device can then be disengaged from the or each previously raised mast segment and, for example, brought into an initial position.

Alternatively, the or each previously raised mast segment is lowered onto the mast segment fixed in the erecting structure by means of the lifting device, so that in the course of lowering a load is transferred to the mast segment fixed in the erecting structure and to the erecting structure. Then, too, the lifting device can be disengaged from the or each previously raised and then lowered mast segment and, for example, brought into an initial position.

The newly erected mast segment can then be raised by means of the lifting device together with the or each previously raised mast segment and the process is repeated until all mast segments have been raised into the mast shaft. Here, too, the erecting structure functions as a guide of the or each mast segment or for the or each mast segment and like a rail system or in the manner of a rail system.

The mast structure erected in this way (first variant or second variant) is fixed in the mast shaft and functions at least as a torque support and/or as a guide for the respective drill string drive unit, for example a top drive. The fixation in the mast shaft takes place along the vertical axis of the mast shaft and transversely to the vertical axis of the mast shaft. Optionally, this mast structure also carries the crown bearing of the drilling rig, wherein—as already mentioned—the crown bearing can be raised by means of the mast structure or independently of the erection of the mast structure in the mast shaft.

In a particular embodiment of a method for erecting a drilling rig (underground drilling rig), which also comprises the erection of a mast structure, it is provided that the erecting structure comprises two devices arranged spaced apart and parallel to one another, which each carry a guide profile. The devices comprised by the erecting structure and arranged parallel to one another, are intended together for erecting in each case at least one mast segment for a "two-legged" mast structure or an at least "two-legged" ("three", four or "multi-legged") mast structure and are accordingly referred to below as erecting trestles. In the case of a two-legged or at least two-legged mast structure as described above, this comprises two continuous, parallel vertical sections serving for load absorption/load dissipation. Between these there is a strut which ensures the static stability of the mast structure and the spacing between the vertical sections. In such a mast structure, each mast segment provided therefore likewise has two parallel sections, which later become part of the vertical sections of the mast structure. Each mast segment also has a strut between these parallel sections, which constitute the strut of the later mast structure. Each erecting trestle of the erecting structure in each case accommodates one of these parallel sections of the mast segments.

The guide profile of each erecting trestle allows a mast segment fed to the erecting structure to move along the guide profiles and causes such a mast segment to be guided transversely to a longitudinal extension of the respective guide profile. For example, a U-profile or the like, that is connected to the erecting trestle or formed in the erecting trestle and is open at the top or side, functions as the guide profile.

In the case of a U-profile as a guide profile, it is preferably provided that its base has a friction-reducing layer, for example, in the form of sliding plates (sliding pads) made of plastic or metal. Instead of a U-profile, in principle any other profile that is suitable for guidance transversely to a longitudinal extension of the respective guide profile can also be used, for example, an I-profile, an L-profile, a T-profile and so on. In the case of such profiles, too, a friction-reducing layer of the type mentioned above is preferably provided in the area, in which the mast segment moved along the guide profile comes into contact with the profile.

A first section of the guide profiles is located at a first end of the erecting trestles. This is aligned horizontally there. This first end of the erecting trestles functions as the input side of the erecting structure. A second section of the guide profiles is located at a second end of the erecting trestles opposite the first end. This is aligned vertically there. The vertical sections of the guide profiles below the mast shaft point into the mast shaft. At least the second end of the erecting trestles of the erecting structure erected in the production tunnel is therefore located below the mast shaft. This second end of the erecting trestles functions as the output side of the erecting structure.

The two sections of the guide profiles are connected to one another along the erecting trestles, so that a continuous or at least for the sections of the mast segments to be guided by means of the guide profiles continuous guide profile results. When the mast structure is erected into the mast shaft, in each case a mast segment is fed to the erecting structure in the area of the first section of the guide profile there (input side). This mast segment is moved along the guide profiles and is erected in the area of the second sections of the guide profiles there (output side) by means of the second sections of the guide profiles.

The guide profiles of the two erecting trestles function like a rail system for the mast segments as they move from the input side to the output side. They ensure the guidance of each individual mast segment when moving along the guide profiles—for example by means of a pulling or pushing drive device or by means of a lifting device as described above. They also ensure correct alignment and positioning of successive mast segments with respect to one another.

In summary, the erection of the mast structure in the mast shaft and, correspondingly, this aspect of the method for erecting a drilling rig (underground drilling rig) can also be briefly described as follows: The erecting of the mast structure in the mast shaft takes place by means of the erecting structure, by in each case at least one mast segment being pulled or pushed on an input side of the erecting structure in the erecting structure in the horizontal direction and/or being raised (pushed up/pressed up) on an output side of the erecting structure in or on the erecting structure in the vertical direction.

The method proposed here for erecting a drilling rig (underground drilling rig) and individual embodiments of the method does not define or do not define the complete erection of the drilling rig. In addition to the method steps proposed here, the erection of a drilling rig includes many other individual method steps, which are known per se and which do not contribute anything to the present invention. The method steps proposed here are, however, carried out to erect a drilling rig or—in another formulation—when erecting a drilling rig of the type proposed here. Correspondingly, with every formulation "method for erecting a drilling rig" the formulation "method when erecting a drilling rig" must also be read, wherein a "method when erecting a drilling rig" is a partial aspect of a "method for erecting a drilling rig".

For the further description, in order to avoid unnecessary repetition, it applies that features and details that are described in connection with the present method and possible embodiments thereof naturally also apply in connection with and with regard to an apparatus intended and configured for carrying out the method and vice versa. Accordingly, the method can also be advanced by means of individual or several method features that relate to method steps carried out by such an apparatus, and such an apparatus can likewise be advanced by means for carrying out method steps carried out within the scope of the method. Consequently, features and details that are described in connection with the present method and possible embodiments thereof naturally also apply in connection with and with regard to an apparatus intended for its implementation and vice versa, so that with regard to the disclosure of the individual aspects of the invention, reference is or can always be made reciprocally.

In this respect, the innovation proposed here is, for example, the apparatus already mentioned and referred to as an erecting structure for erecting a drilling rig of the type mentioned at the beginning underground, namely an apparatus for erecting a mast structure of the drilling rig comprising a plurality of mast segments connected to one another or connectable with one another. At least one mast segment can be fed to the erecting structure in a horizontal orientation on an input side. A mast segment fed to the erecting structure on its input side is moved—for example by means of a corresponding drive device—through the erecting structure or along the erecting structure to an output side of the erecting structure and guided by means of the erecting structure and can correspondingly be guided through the erecting structure or along the erecting structure to an output side there. In the area of the output side, a mast segment guided thereto can be erected and is brought into a vertical orientation that is aligned with the vertical axis of the mast shaft. Furthermore, the innovation proposed here is also, for example, a mast structure of a drilling rig for sinking deep boreholes underground, namely a drilling rig with a mast structure, wherein the mast structure comprises a plurality of mast segments connected to one another or connectable to one another and wherein the mast structure is erected underground, by in each case at least one mast segment being erected in a vertical orientation into the mast shaft or at least pointing into the mast shaft and by the or each already erected mast segment being raised into the mast shaft by means of further mast segments. The result is a mast structure consisting of several mast segments erected underground "from below"—namely extending from the production tunnel into a mast shaft. The totality of the mast segments essentially determines the height of the mast structure.

The patent claims submitted with the application presented here are formulation proposals without prejudice for obtaining further patent protection. Since, in particular, the subject matter of the dependent claims may form separate and independent inventions in view of the prior art at the priority date, the applicant reserves the right to make these or still further combinations of features, hitherto disclosed only in the description and/or drawing, the subject matter of independent claims or divisional applications. They can also contain independent inventions having a configuration that is independent of the subjects of the preceding dependent claims.

An embodiment of the invention is explained in more detail below with reference to the drawing. Objects or elements that correspond to one another are provided with the same reference numerals in all figures and—insofar as this is possible with regard to the clarity of the illustrations—are also designated in all figures with the respective reference numerals.

The or each embodiment is not to be understood as a limitation of the invention. Rather, changes are definitely also possible within the scope of the present disclosure, in particular those, which, for example, by combining or modifying individual features described in connection with the general or special description part and contained in the claims and/or the drawing can be inferred by a person skilled in the art with a view to solving the problem and, through combinable features, lead to a novel subject matter or to new method steps or sequences of method steps.

DETAIL DESCRIPTION OF ILLUSTRATED EMBODIMENTS

Figure 1C:
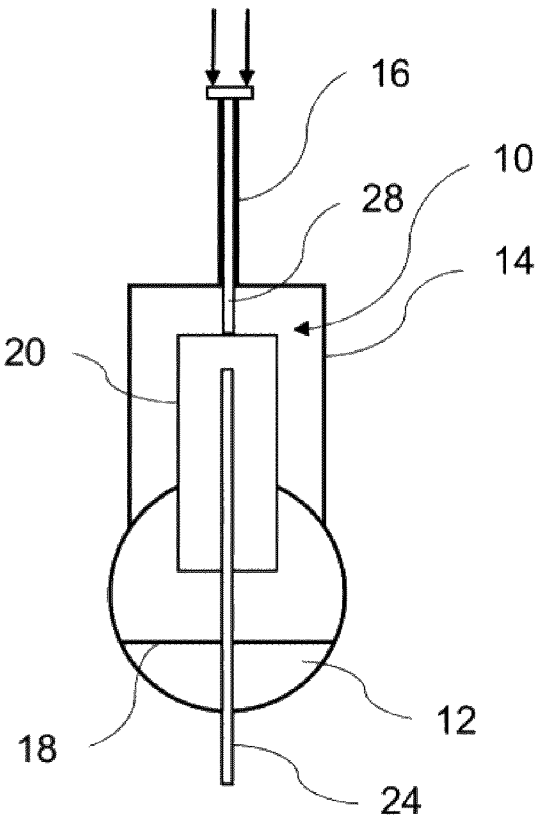
FIG. 1 shows, in a highly schematically simplified form, different variants of a design of a drilling rig underground (underground drilling rig)
Figure 1B:
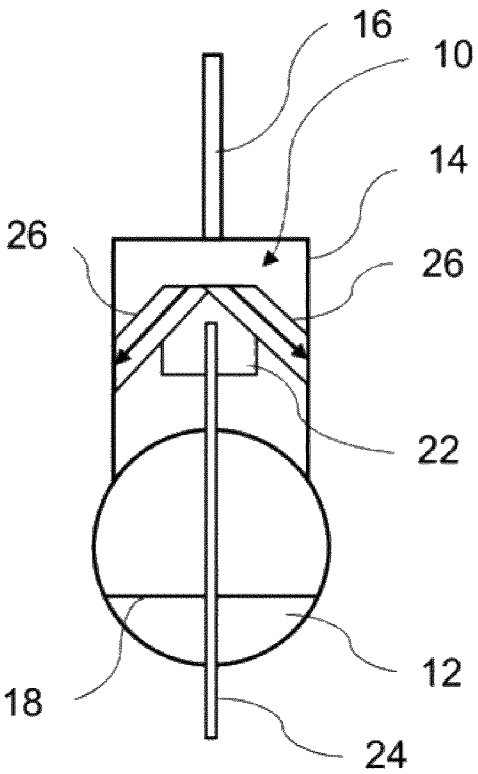
Figure 1A:
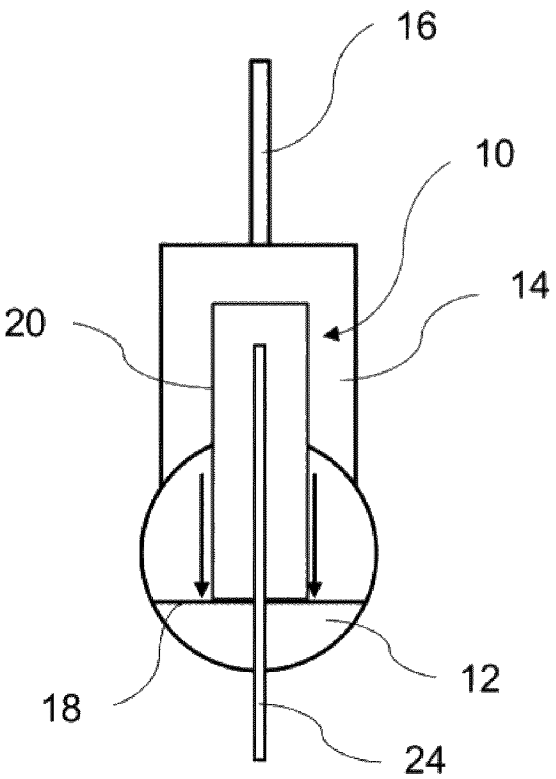

The illustration in FIG. 1 (FIG. 1A, FIG. 1B, FIG. 1C) shows in a greatly simplified schematic form a drilling rig 10 underground (underground drilling rig 10). The drilling rig 10 is erected underground in a horizontal tunnel, referred to here and below as production tunnel 12, from which a vertical shaft, referred to below as mast shaft 14, extends. From the mast shaft 14, in an in principle optional manner, at least one ventilation shaft 16 extends up to the surface above ground.

In the production tunnel 12, which has a circular or at least substantially circular cross-sectional contour, a floor level 18 of the production tunnel 12 is formed, for example, at least in the area that is intended for the erection of the drilling rig 10, in order to obtain a level or at least substantially level installation surface by heaping up excavated material and/or by attaching a standing surface, which functions as a floor level 18, which, if necessary, rests on heaped up excavated material.

In the schematically greatly simplified illustration of the drilling rig 10, a mast structure 20 (FIG. 1A) and a crown bearing 22 (FIG. 1B, FIG. 1C) are shown. At the upper end of the mast structure 20 a crown bearing 22 connected to the mast structure 20 can be located, or above the mast structure 20 a crown bearing 22 can be located that is independent of the mast structure 20 or that is connected to the mast structure 20, as shown in FIGS. 1B, 1C.

The illustrations in FIG. 1A, FIG. 1B and FIG. 1C illustrate by means of the respective arrows the dissipation of the forces acting during the drilling operation, in particular due to the weight of the drill string 24 (or so-called casing pipes). In the situation in FIG. 1A, the forces are directed into the ground due to the mast structure 20 standing directly or indirectly on the floor level 18 of the production tunnel 12. In the situation in FIG. 1B and FIG. 1C, the crown bearing 22 is to a certain extent suspended in the mast shaft 14 at a distance from the production tunnel 12. In the situation in FIG. 1B, the crown bearing 22 is fixed in the mast shaft 14 along its vertical axis and transversely to its vertical axis by means of struts 26 extending from the crown bearing 22 and reaching the wall of the mast shaft 14 (mast shaft wall). In the situation in FIG. 10, the crown bearing 22 (in a configuration connected to a mast structure 20 or individually and without a connection to a mast structure 20) is fixed in the mast shaft 14 at least along its vertical axis by means of a suspension 28 extending from the surface above ground, through the ventilation shaft 16 and to the crown bearing 22. An additional fixation transversely to its vertical axis can be provided according to FIG. 1B.

Figure 2:
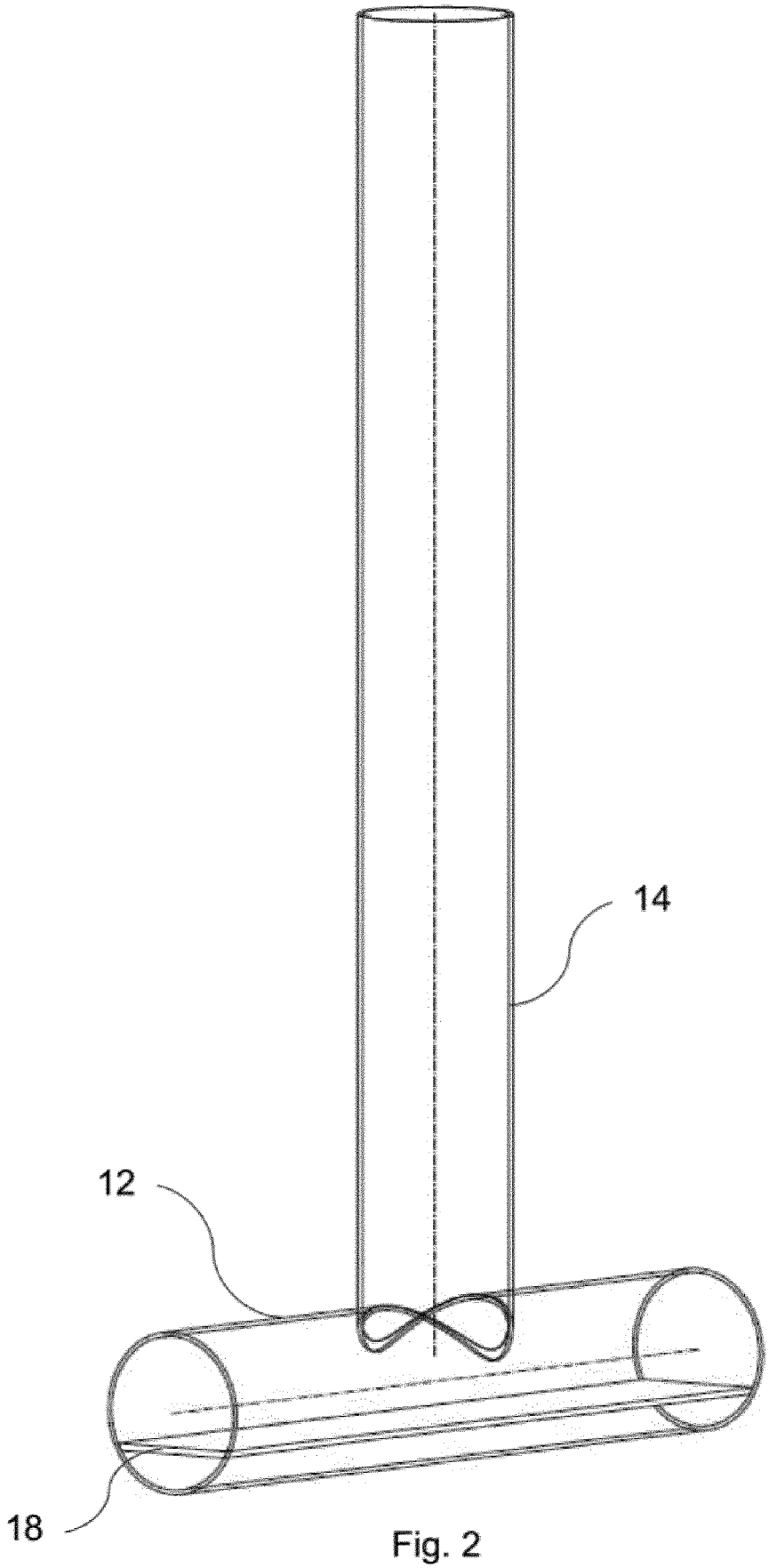
FIG. 2 shows a tunnel in a rock mass with a horizontal section (production tunnel) and a vertical shaft extending therefrom (mast shaft), wherein the erection of the underground drilling system takes place in the production tunnel and at least partially into the mast shaft.

FIG. 2 shows an isometric illustration of a section of the production tunnel 12 and the mast shaft 14 extending from the production tunnel 12 in the vertical direction.

Figure 3A:
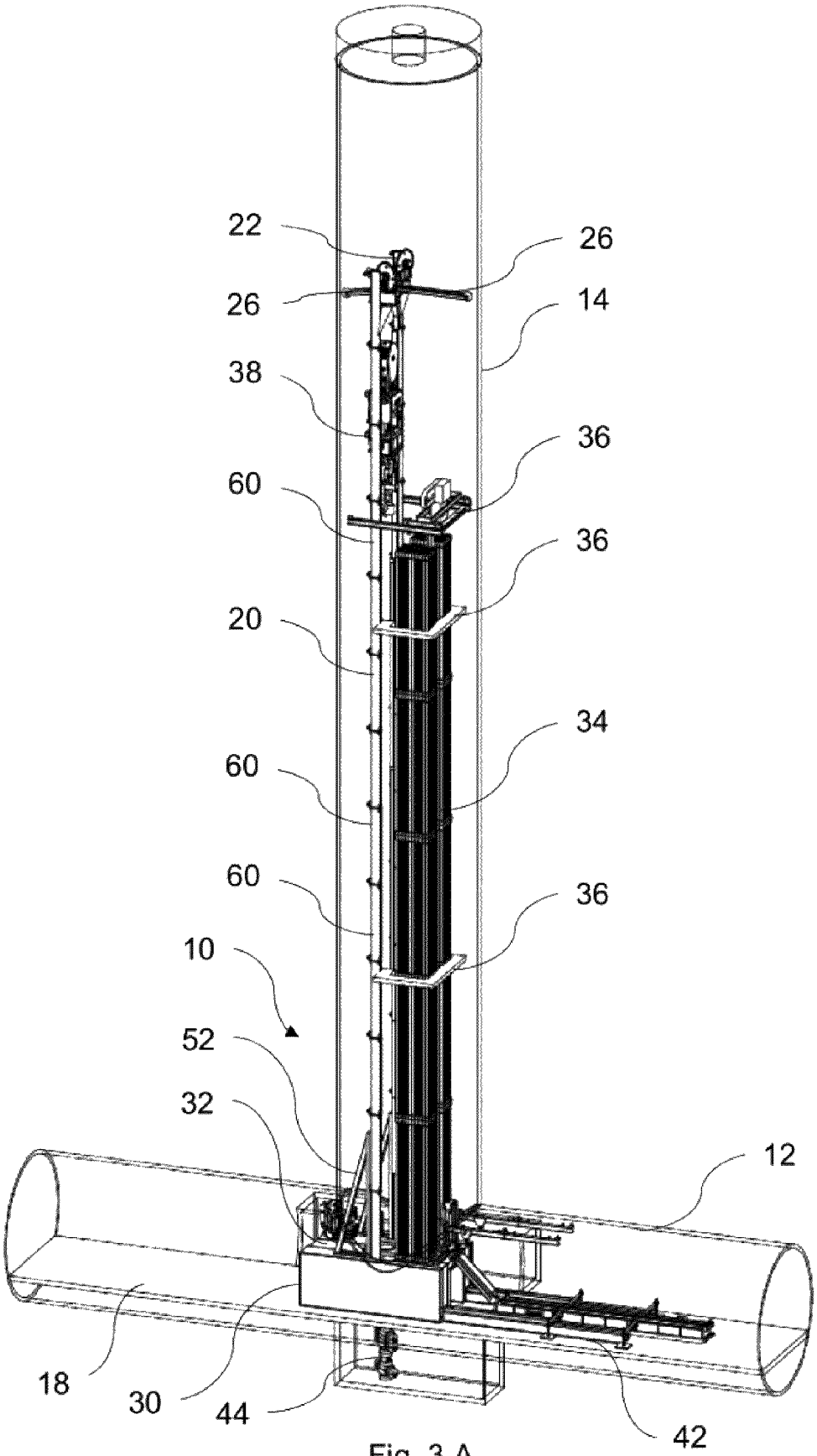
FIG. 3 and FIG. 4 show different views/partial views of an underground drilling rig erected in the production tunnel with a mast structure extending into the mast shaft.
Figure 3B:
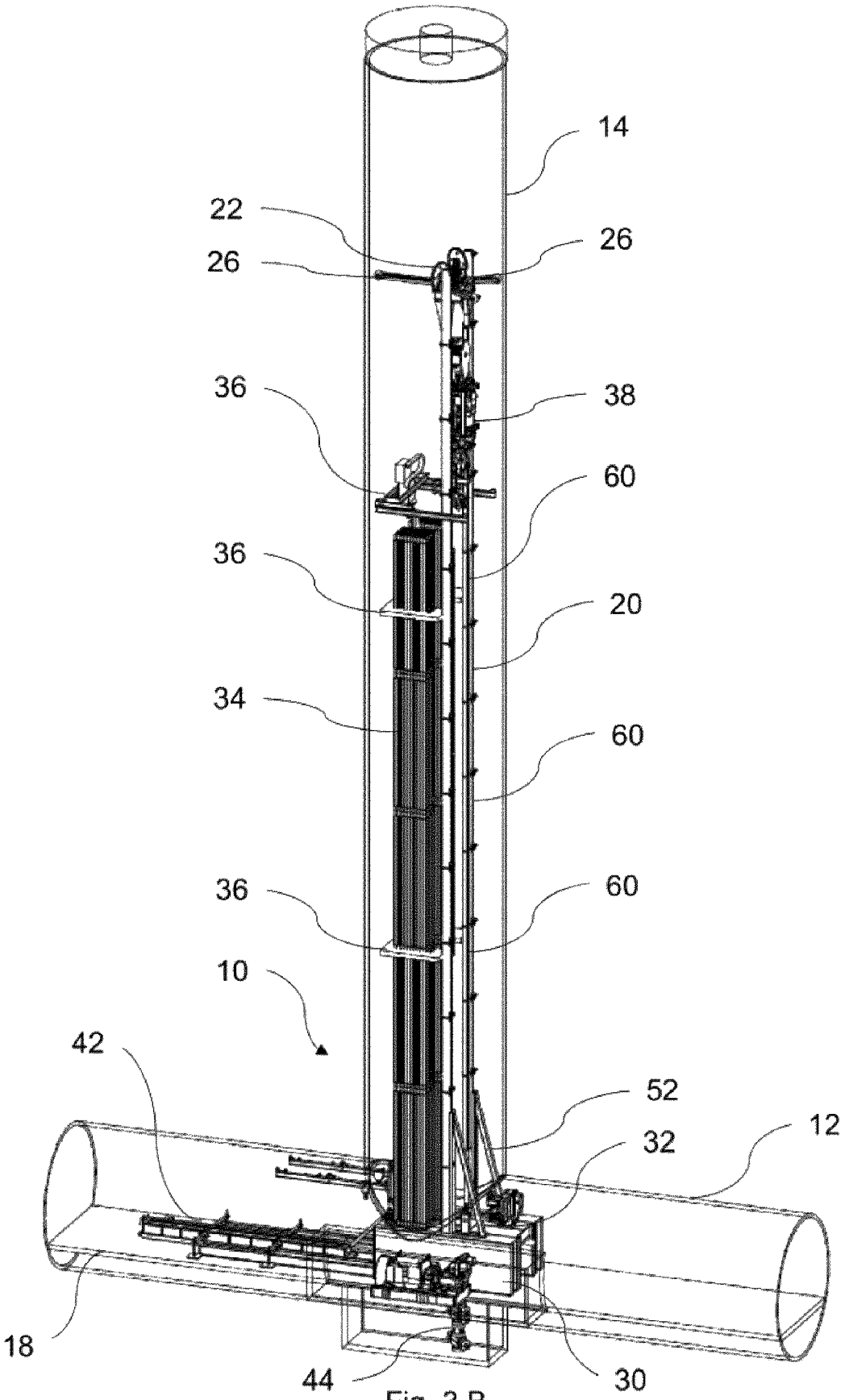

The illustrations in FIG. 3 (FIG. 3A, FIG. 3B) show—from different viewing directions—a drilling rig 10 erected in a production tunnel 12 and into a mast shaft 14 extending therefrom. The illustration in FIG. 4 shows this drilling rig 10 in the area of the production tunnel 12 and of a section of the mast shaft 14 directly adjoining the production tunnel 12 in a view when looking along the longitudinal axis of the production tunnel 12.

Figure 4:
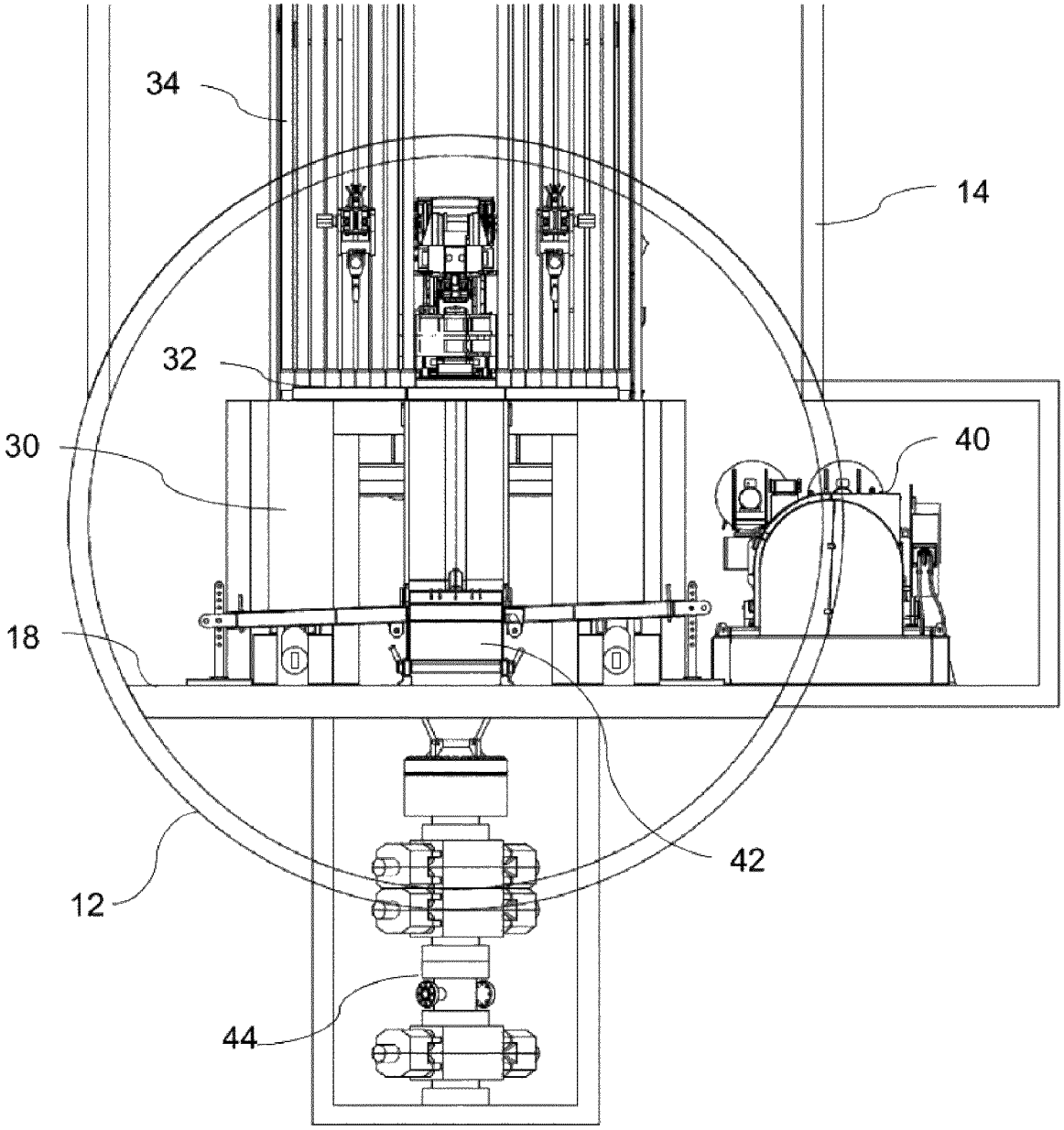

The illustrations in FIG. 3 and in FIG. 4 show the drilling rig 10 with further details compared to the illustrations in FIG. 1. Accordingly, the drilling rig 10 comprises, in addition to the mast structure 20 and the crown bearing 22, a substructure 30 with the so-called drill floor 32 as the upper end of the substructure 30. In the embodiment shown, the mast structure 20 of the drilling rig 10 is a "two-legged" mast structure 20. On the drill floor 32, a plurality of drill pipe elements 34 are placed next to the mast structure 20. These are held in a manner which is in principle known per se by means of at least one holding structure extending from the mast structure 20, in particular a holding structure in the form of or in the manner of a so-called finger board 36. Drill pipe elements 34 are placed there next to the mast structure 20 in a manner which is in principle known per se. When installing the drill string 24, drill pipe elements 34 are accommodated there in a manner which is in principle known per se and connected to the drill string 24. In the embodiment shown, the drill pipe elements 24 placed next to the mast structure 20 are each drill pipe elements 24 (quintuple stands) combined from five individual drill pipes. Drill pipe elements 24 with more or less than five individual drill pipes are also conceivable and usable, especially in a drilling rig 10 with a correspondingly adapted height of the mast structure 20 and/or a correspondingly adapted vertical position of at least one holding structure extending from the mast structure 20.

The movement of drill pipe elements 34 from and to the position above the borehole underground and from and to the position next to the mast structure 20 takes place in the drilling rig 10 shown by way of example by means of a drill string drive unit, in particular a so-called top drive 38 that functions as a drill string drive unit and is in principle known per se. The drill string drive unit, the top drive 38 in the situation shown, can be moved vertically along the mast structure 20 in a manner which is in principle known per se. By means of the drill string drive unit, the drill string 24 is rotated during the drilling operation in a manner which is in principle known per se. The vertical movement of the drill string drive unit takes place in a manner which is in principle known per se by means of a hoisting apparatus 40 (FIG. 4) and a pulley system in principle known per se, comprising the crown bearing 22 as the upper block.

In order to feed drill pipe elements 34 to the drill floor 32, a machine, which is in principle known per se, is arranged for this purpose in the production tunnel 12 and in alignment with the longitudinal axis of the production tunnel 12. As an example of such a machine, a so-called catwalk machine 42 is shown in the illustrations in FIG. 3A and FIG. 3B.

Below the drilling rig 10, a so-called blow-out preventer 44 (BOP) is located above the borehole in a manner which is in principle known per se. To accommodate it, the production tunnel 12 is extended (deepened) in a cellar-like manner below the drilling rig 10 and in the region of the borehole. Similar to the way in which a section extending from the production tunnel 12 and extending beyond the edge contour of the production tunnel is provided for the blow-out preventer 44—as the illustration shows this in FIG. 4—a side room optionally extending from the production tunnel 12 is provided for the hoisting apparatus 40. The arrangement of the hoisting apparatus 40 shown here is only an example and can also assume alternative positions.

The illustrations in FIG. 5 (FIG. 5A, FIG. 5B, FIG. 5C, FIG. 5D) show a section of the production tunnel 12 and a section of the mast shaft 14 extending therefrom, as well as a mast structure erecting structure intended for erecting the mast structure 20 in the mast shaft 14 and referred to here and below in short as an erecting structure (erecting unit) 50. The representations in FIG. 5 likewise illustrate a method for erecting this erecting structure 50, which can also be referred to as an erecting apparatus.

Figure 5A:
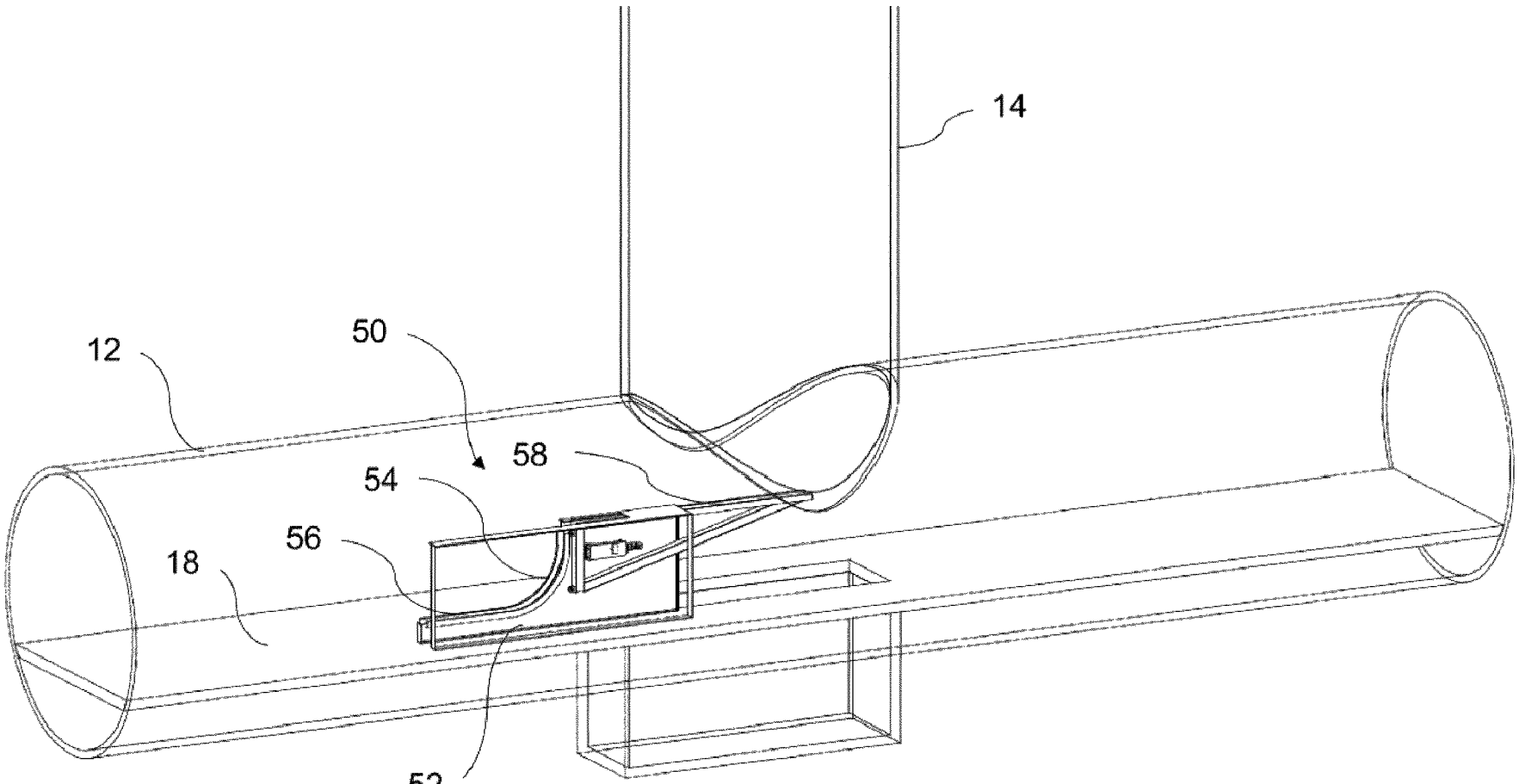
FIG. 5 shows snapshots during the installation of an erecting structure intended for erecting the mast structure in the mast shaft.
Figure 5B:
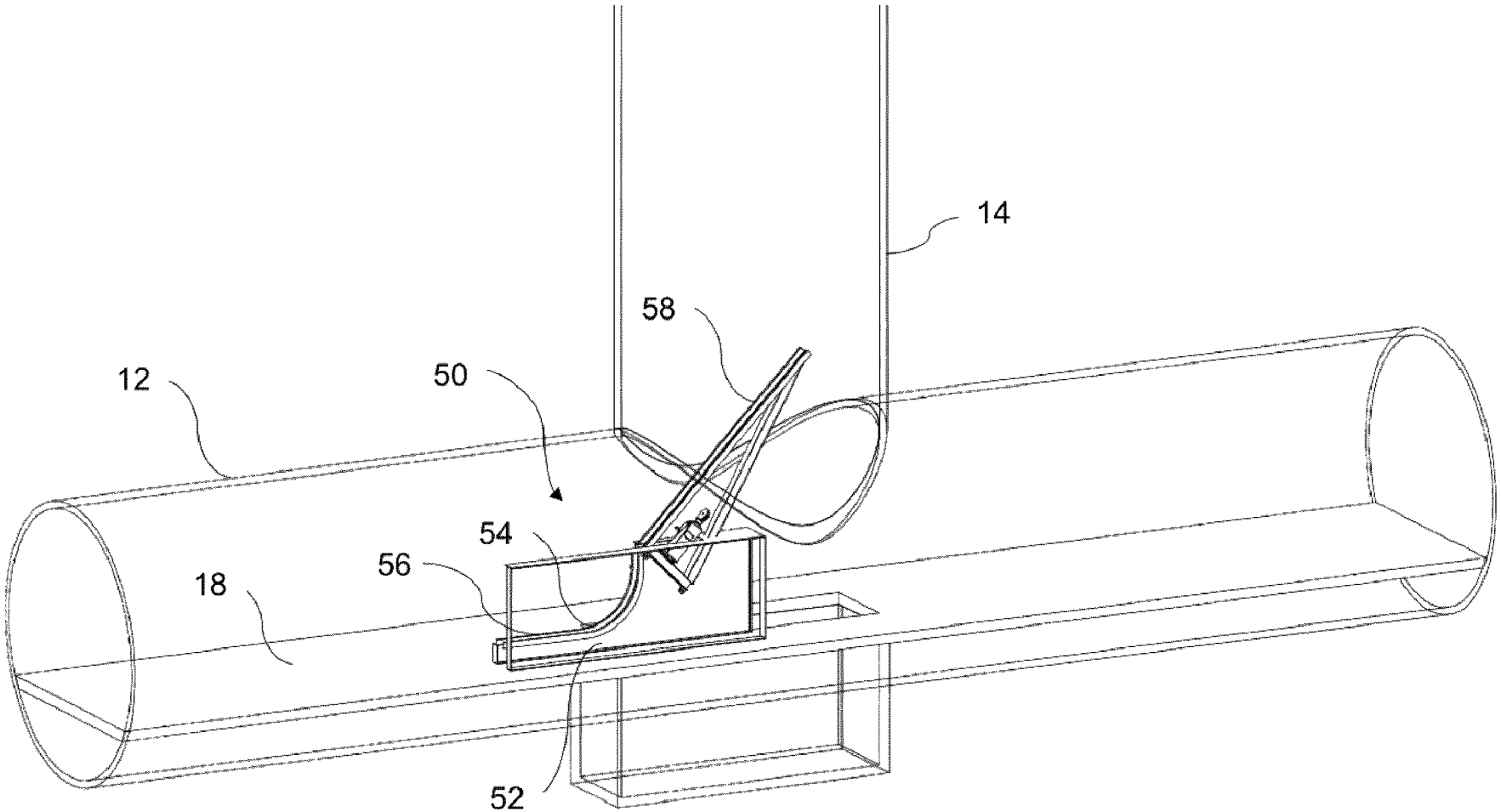
Figure 5C:
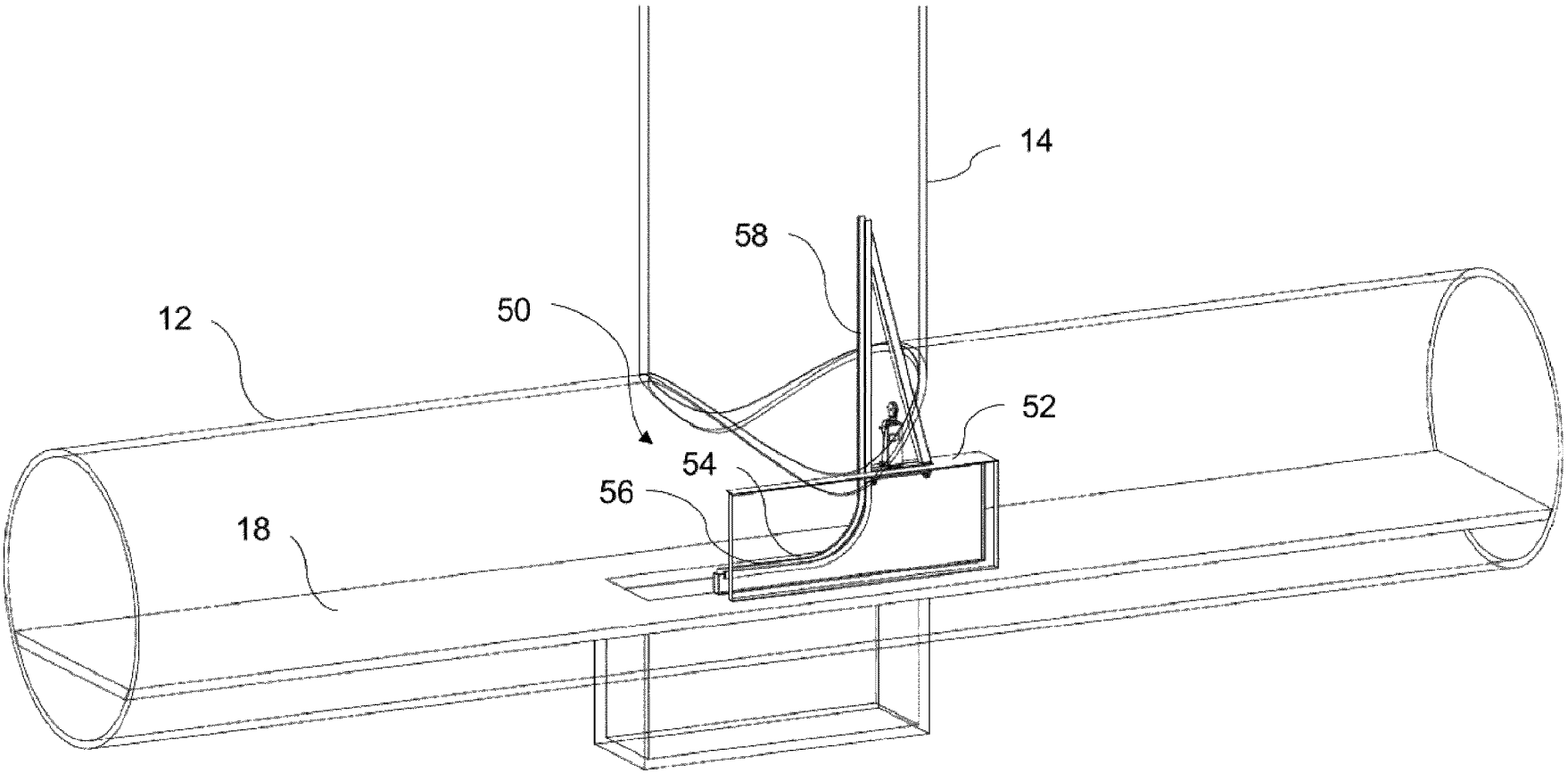
Figure 5D:
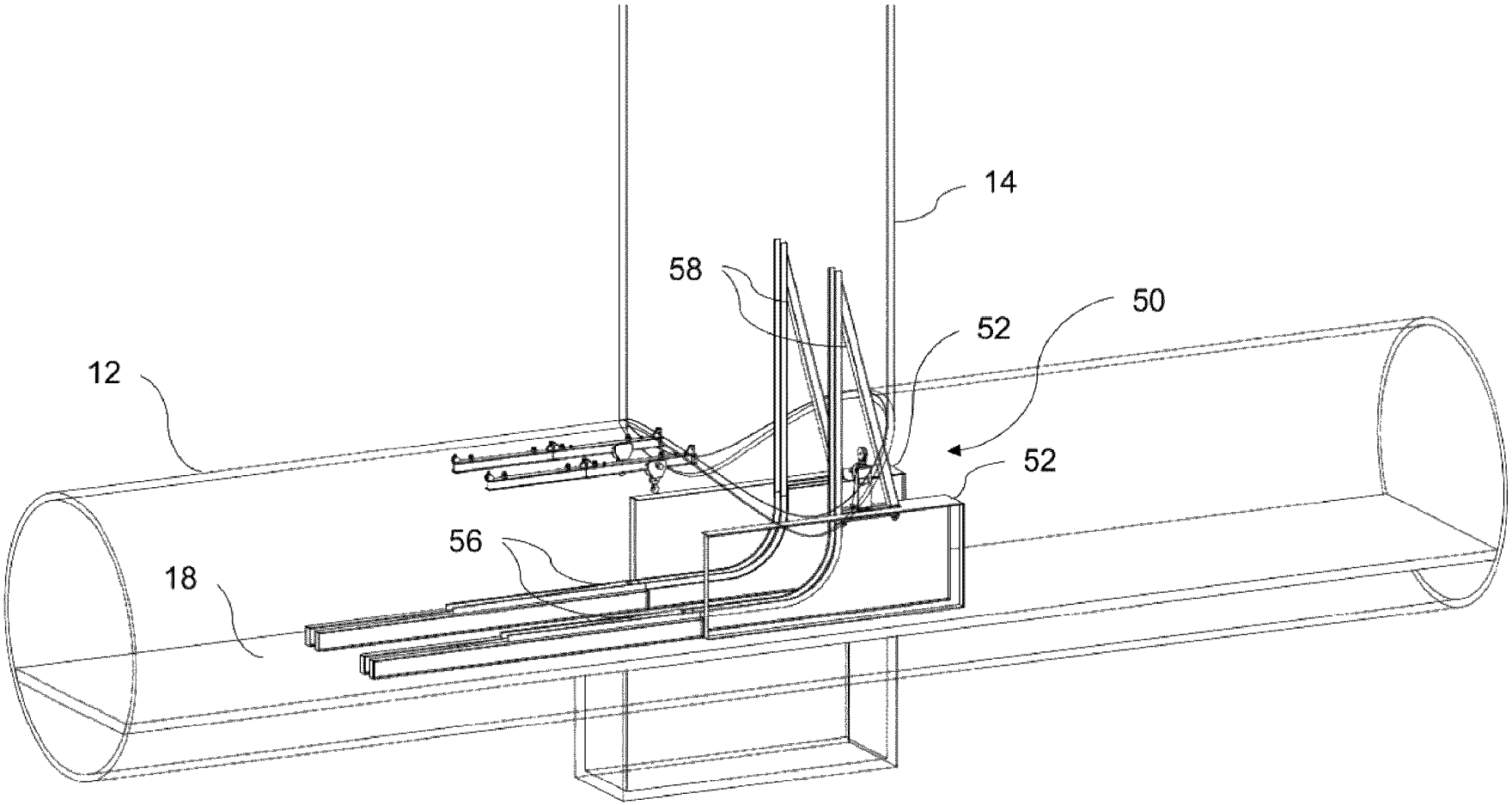

In the embodiment shown, the erecting structure 50 comprises two erecting trestles 52 aligned side by side and parallel to one another (see FIG. 5D). Each erecting trestle 52 comprises a guide for segments of the mast structure 20 to be erected by means of the erecting trestles 52 and guide profiles 54 as a guide.

The guide and the guide profiles 54 there are divided into at least three adjoining sections and function as a continuous guide. In respect to the illustrations in FIG. 5C and FIG. 5D and the direction of view there on the erecting trestle 52 or the erecting trestles 52, these are—when viewed from approximately bottom left to approximately top right—a horizontal section 56, preferably a horizontal section 56 that is aligned with a longitudinal axis of the production tunnel 12, an adjoining arc-shaped section and, in turn, a vertical section 58 adjoining it. The vertical section 58 extends into the mast shaft 14 and with its total height beyond the ceiling of the production shaft 12. The vertical section 58 is therefore erected into the mast shaft 14. This is shown by the illustrations in FIG. 5A and FIG. 5B.

The illustration in FIG. 5A shows, in a snapshot, an erecting trestle 52 with an initially still lowered (horizontally oriented) vertical section 58. The erecting trestle 52 is located under the mast shaft 14 only with a part of the vertical section 58 to be erected. The illustration in FIG. 5B shows, in a snapshot, the erecting trestle 52 from FIG. 5A with a partially erected vertical section 58. The erecting takes place, for example, by means of a hydraulic cylinder or the like engaging with the erecting frame 52, on the one hand, and with a boom extending from the vertical section 58, on the other hand, or by means of a separate lifting device. When erecting the vertical section 58 and together with the erection, the erection trestle 52 is moved further under the mast shaft 14 (when comparing the illustrations in FIG. 5A and FIG. 5B, it can be seen, that the erecting trestle has been moved "to the right", therefore further under the mast shaft 14).

The illustration in FIG. 5C shows, in a snapshot, the erecting trestle 52 from FIG. 5B with an erected vertical section 58. The vertical section 58 adjoins the arc-shaped section of the guide and the result is a continuous guide with an input-side horizontal section 56, an adjoining arc-shaped section and, in turn, an adjoining output-side vertical section 58.

At the end of the erection of the vertical section 58, the erection trestle 52 is also moved further under the mast shaft 14. In the situation shown in FIG. 5C, it can be seen that the erecting trestle 52 has already been partially moved beyond the area with the mast shaft 14. The vertical section 58 protrudes into the mast shaft 14 and a longitudinal axis of the vertical section 58 is aligned with a vertical axis of the mast shaft 14. When comparing the illustrations in FIG. 5B and FIG. 5C, it can be seen that the erecting trestle 52 has been moved "further to the right", therefore even further under the mast shaft 14 and partly beyond the area with the mast shaft 14.

The illustration in FIG. 5D shows two erecting trestles 52 placed next to one another, each with erected vertical sections 58 as in FIG. 5C. The illustration in FIG. 5D also shows an in principle optional extension of the horizontal sections 56 in front of the erecting trestles 52 and aligned with a longitudinal axis of the production tunnel 12. The illustration in FIG. 5D (but also other illustrations) furthermore shows in an area above the horizontal sections 56 an optional crane system in front of the erecting trestles 52. This is attached, for example, to the ceiling of the production tunnel 12. By means of such or a similar crane system, mast segments 60 delivered, for example, in the production tunnel 12 by means of a vehicle traveling there or the like can be placed on the horizontal sections 56 in front of the erecting trestles 52. Such a or a similar crane system can optionally also or alternatively also be used in other ways, for example, for lowering the BOP 44 into the area of the production tunnel 12, which is deepened in the manner of a cellar.

The denomination of the individual sections 56, 58 of the guide as input side and output side relates to a direction of a movement of segments of the mast structure 20 when the mast structure 20 is erected along the guide and thus overall in the erecting structure 50. The erection of the mast structure is shown in FIG. 6.

The illustrations in FIG. 6 (FIG. 6A, FIG. 6B, FIG. 6C, etc.) show snapshots during the erection of the mast structure 20 of a drilling rig 10 according to FIG. 3 and FIG. 4. The mast structure 20 is a "two-legged" mast structure 20 and is formed from individual mast segments 60 connected to one another or connectable to one another. The "two-legged" mast structure 20 is selected here only as an example and can also have other embodiments, in particular, a multi-legged mast structure 20 with three or more legs is possible, in which two adjacent legs form a contact surface for placement in the erecting structure 50.

Figure 6A:
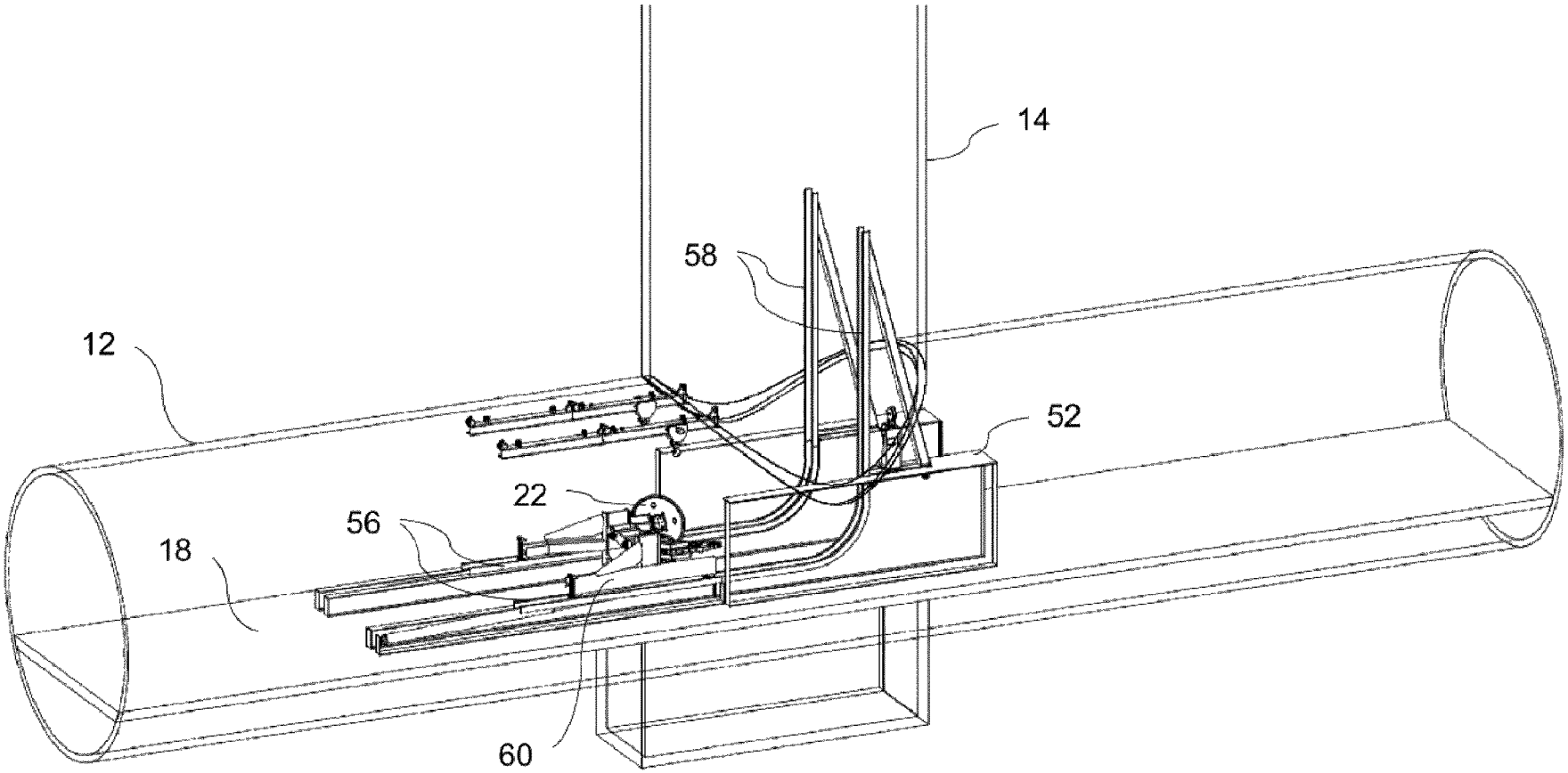
FIG. 6 shows snapshots when erecting the mast structure into the mast shaft by means of the erecting structure.

The illustration in FIG. 6A shows a snapshot with a first mast segment 60 placed in the erecting structure 50. The mast segment 60 is placed in the area of the horizontal section 56 of the guide profiles 54 of the erecting trestles 52 (input side of the erecting structure 50), here even by way of example in the area of the extension in front of the horizontal sections 56 on the guide profiles 54 there.

In the example shown, the mast segment 60 placed on the guide profiles 54 comprises the crown bearing 22. This mast segment 60 is later the top segment of the mast structure 20 in the erected mast structure 20, so that the crown bearing 22 is raised together with the erection of the mast structure 20. The mast structure 20 is thereby erected into the mast shaft 14 and with this erection the crown bearing 22 is also raised into the mast shaft 14. Thus, after the mast structure 20 has been erected, the crown bearing 22 is located at the top of the mast structure 20, therefore, in the area of the highest point of the mast structure 20.

It should be pointed out that a crown bearing 22 connected to a mast segment 60 is only an option and that for erecting the mast structure 20 it does not depend on whether a crown bearing 22 is connected to one of the mast segments 60. For the further description of the erection of the mast structure 20, the crown bearing 22 is therefore no longer taken into account. A crown bearing 22 connected to a mast segment 60, in particular, a crown bearing 22 connected to the first mast segment 60 placed on the erecting structure 50, and a crown bearing 22 raised with the erection of the mast structure 20 are nevertheless always to be read in the further description.

Figure 6B:
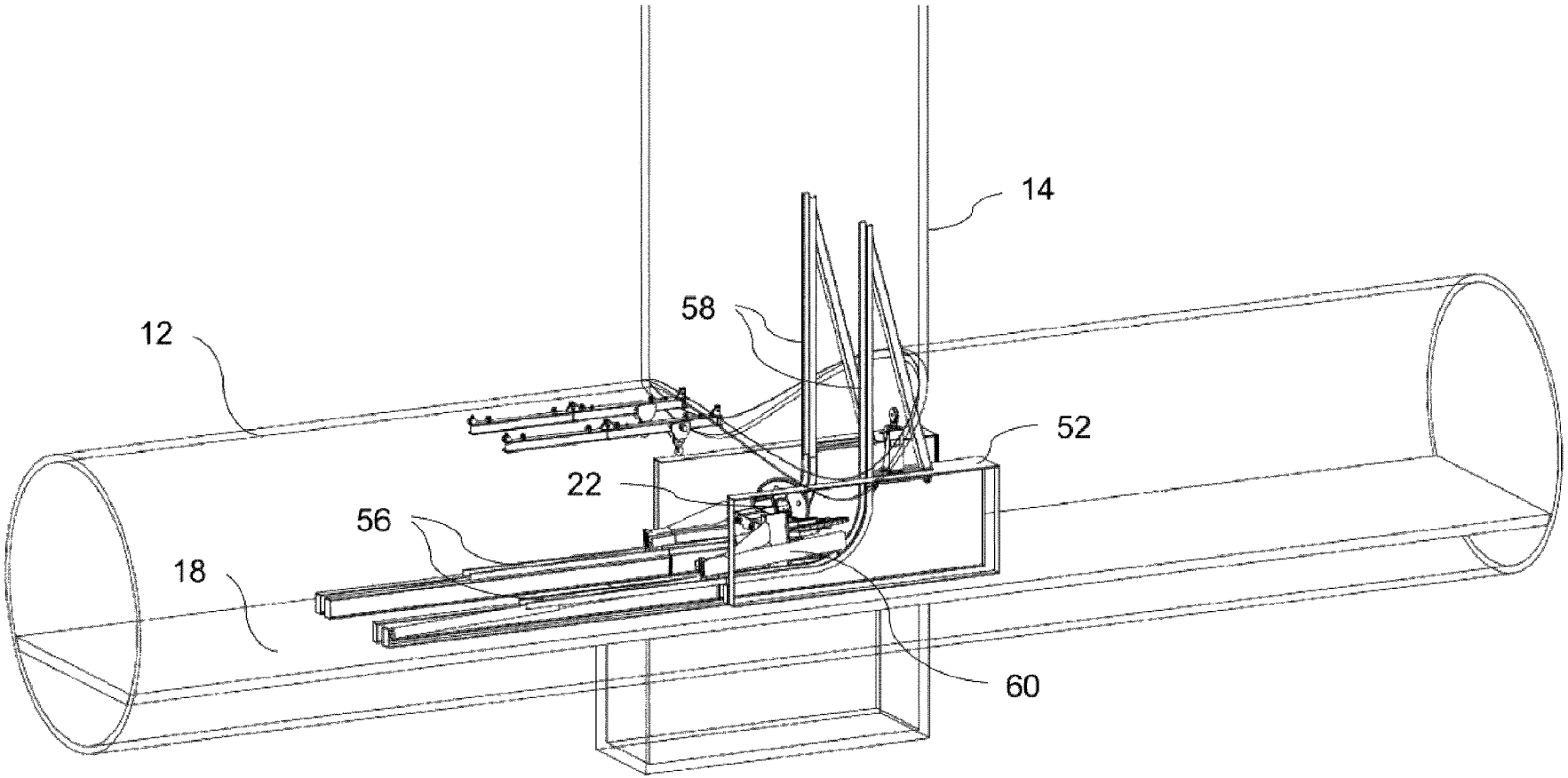

The illustration in FIG. 6B shows a snapshot with a mast segment 60 moved further along the erecting structure 50 and the guide profiles 54 of the erecting trestles 52 compared to the situation in FIG. 6A, namely a mast segment 60 moved further in the direction of the arc-shaped sections adjoining the horizontal sections 56. This movement takes place automatically or semi-automatically by means of a drive device not shown in the illustrations. Such a drive device engages—as described above—for example, pulling or pushing, with the mast segment 60 and causes the movement along the guide profiles 54 of the erecting trestles 52 and thus overall along the erecting structure 50. Apparatuses coming into consideration as a drive device have been exemplarily mentioned above.

Figure 6C:
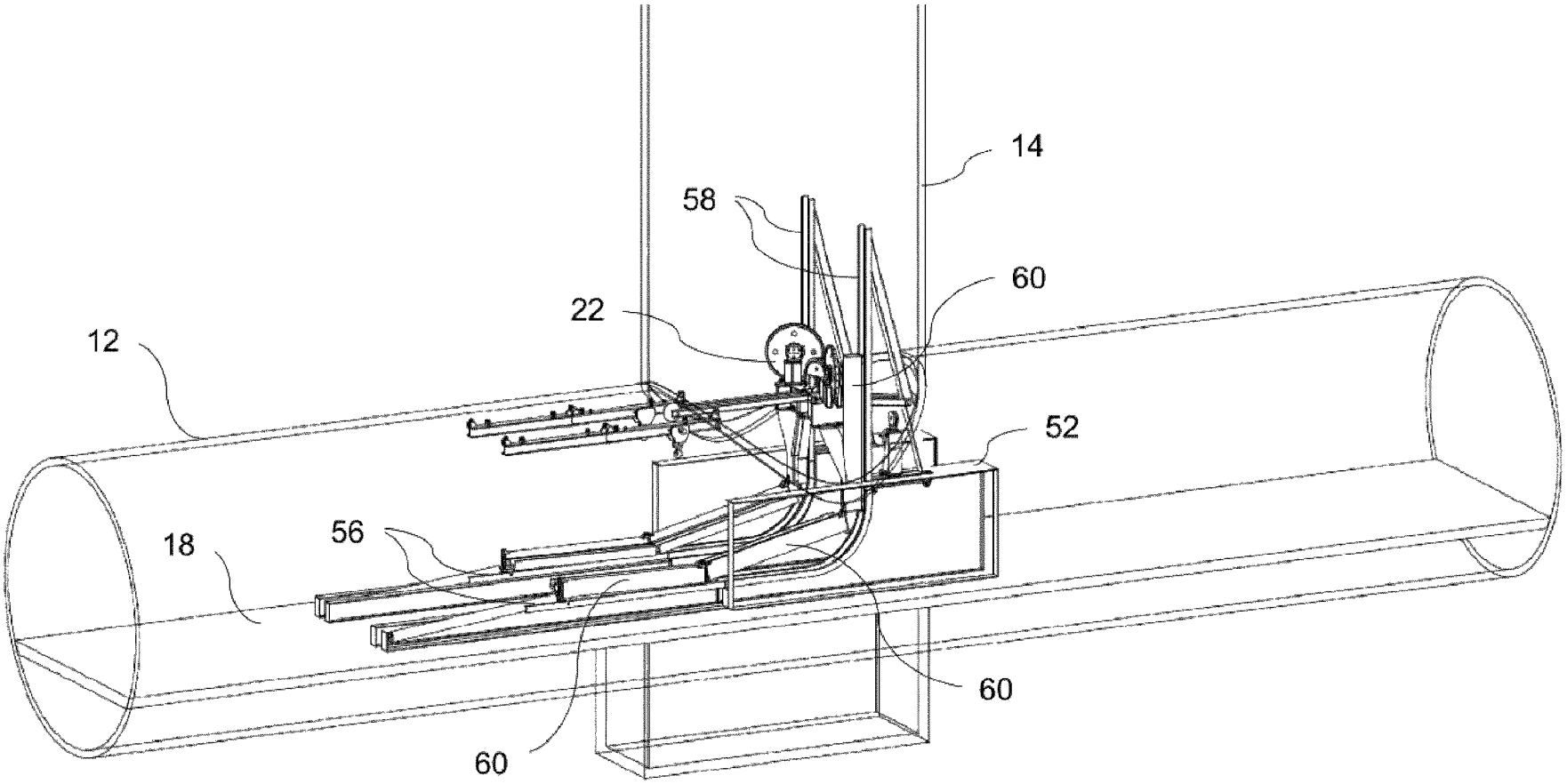

The illustration in FIG. 6C shows the erecting structure 50 and its erecting trestles 52 as in FIG. 6A and FIG. 6B, wherein two further mast segments 60 are now placed on the guide profiles 54 of the erecting trestles 52 (and here partly also on the guide profiles 54 of the extension in front of the erecting trestles 52). The drive device mentioned before in the description of the illustration in FIG. 6B engages with one of these new mast segments 60, in particular, with the last new mast segment 60 and causes its movement along the guide profiles 54 in the direction of the vertical sections 58. The mast segment 60 moved in each case with the drive device pushes each mast segment 60 located in the direction of movement in front of said mast segment 60 in front of it. In the snapshot shown in FIG. 6C, this has the effect that the mast segment 60, which was first placed in the erecting structure 50, was moved into the area of the vertical sections 58 (output side of the erecting structure 50) and there has been erected from the originally horizontal orientation to a vertical orientation.

It should be pointed out that the illustration in FIG. 6C is a snapshot of the erection of the mast structure 20 and that the number of exactly two further mast segments 60 shown there in comparison to the situation in FIG. 6B does not constitute a determining factor for the method for erecting the mast structure 20. It is therefore not necessary that exactly two new mast segments 60 are always fed to the erecting structure 50. The number of new mast segments 60 can be larger or smaller. Which new mast segment 60 or which new mast segments 60 in the case of a plurality of new mast segments 60 is or are moved by means of the drive device along the erecting structure 50 depends on the position of the drive device relative to the erecting structure 50 and, for example, also depends on whether the mast segments 60 or at least the new mast segments 60 are connected to one another, for example—as shown—are connected to one another in an articulated manner.

The drive device, which engages with in each case a mast segment 60 placed in the area of the input side of the erecting structure 50, preferably works in a clocked manner and thereby moves back and forth, for example, in the area of the input side, therefore, in the area of the horizontal sections 56, in each case alternately over a predetermined distance, in particular a distance, whose length is at least slightly greater than the length of a mast segment 60. Each mast segment 60 that comes into the effective area of the drive device by being placed in the erecting structure 50 is detected by the drive device, for example, by a driver moved by the drive device, and then moved in the direction of the vertical sections 58.

Figure 6D:
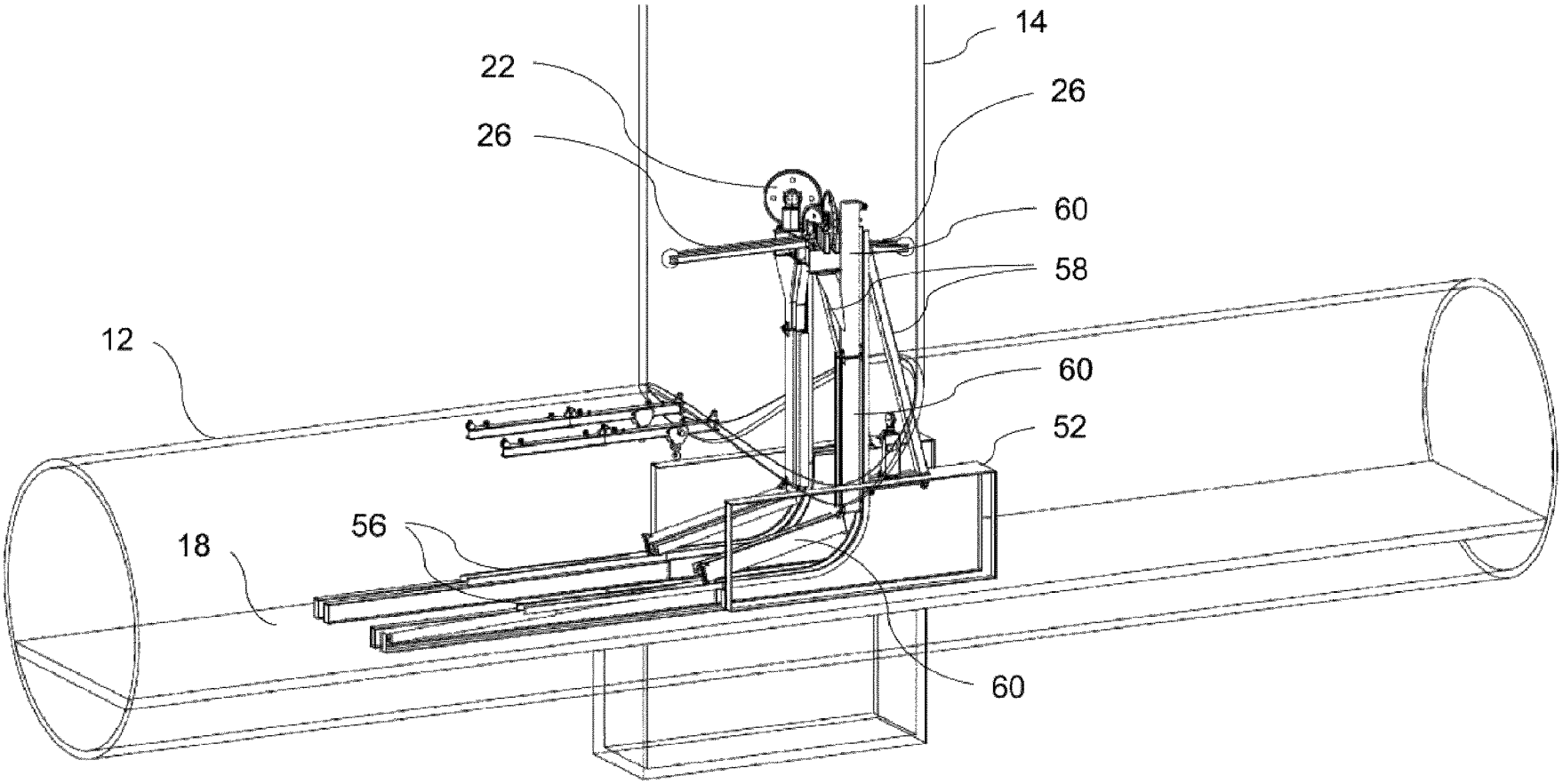

The illustration in FIG. 6D shows a further snapshot when erecting the mast structure 20 in the mast shaft 14. Now, by means of the vertical sections 58 of the guide profiles 54 of the erecting trestles 52, another mast segment 60 is erected and brought into a vertical orientation aligned with the vertical axis of the mast shaft 14. On the first, previously erected mast segment 60, struts 26 extending from the mast segment 60 can be seen, which support the mast segment 60 and thus the mast structure 20 as a whole against the mast shaft 14. These struts 26 have the effect that the mast structure 20 remains upright when the mast structure 20 is further erected in the mast shaft 14 and does not incline against the side wall of the mast shaft 14. In the case of a "two-legged" mast structure 20—as shown—there is a risk of an undesired inclination of the mast structure 20 against the side wall of the mast shaft 14 only transversely to the plane defined by the mast structure 20. With such a configuration, two struts 26 (or in each case two struts 26 at the same height as the mast structure 20) are sufficient to support the mast structure 20 in the mast shaft 14, and these struts 26 are each oriented transversely to the plane defined by the mast structure 20. There is no need for a restriction to precisely two struts 26 and more than two struts 26, for example, two or more struts 26 on each side of the mast structure 20, are also conceivable. Supporting the mast structure 20 by means of precisely two struts 26 is therefore only one of several possible options. The struts 26 support the mast structure 20 during its erection and/or during the later drilling operation. During the later drilling operation, the mast structure 20 can additionally or alternatively be supported in the mast shaft 14 by means of bracing the mast structure 20 in the mast shaft 14 with steel cables or the like or by means of further struts (not shown) along the mast structure 20. In the case of such further struts along the mast structure 20, in each case a group of struts (two or more struts extending from the mast structure 20 and reaching as far as the mast shaft wall) comes into consideration, for example, in different vertical positions. Such a group of struts can extend from each mast segment 60 of the mast structure 20 or from every second or every third or every fourth mast segment 60 of the mast structure 20. As an alternative to such a group formation, it is also possible, for example, for individual mast segments 60, in particular successive mast segments 60, in each case to have struts pointing in different radial directions along the mast structure.

In the illustration in FIG. 6D, the struts 26 are shown as rigid struts 26 extending radially from a vertical axis of the mast structure 20 and reaching to a section of the side wall of the mast shaft 14, at the free ends of which intended for contact with the mast shaft 14 in each case a roller or the like is located. Rigid struts 26 (in the area of the crown bearing 22 and/or along the entire mast structure 20) with rollers or the like at their ends come into consideration for a cylindrical or at least substantially cylindrical mast shaft 14, in any event for a mast shaft 14, the geometry of which and the dimensions of which are known and do not change significantly along its vertical axis. The length of each strut 26 is then matched to the respective distance from the starting point of the strut 26 on the mast segment 60 to the mast shaft wall. The length is of course determined in the direction of the intended orientation of the strut 26 in each case. A roller or the like at the end of a strut 26 dimensioned in this way is preferably mounted resiliently or elastically in some other suitable manner for the purpose of tolerance compensation. It is also conceivable to dispense with the struts 26 (in the area of the crown bearing 22 and/or along the entire mast structure 20). For this purpose, the mast structure 20 is designed to be free-standing in the mast shaft 14. An underground drilling rig 10 with a free-standing mast structure 20 is to be regarded as encompassed by the description presented here and whenever a mast structure 20 erected in the mast shaft 14 is mentioned, a mast structure 20 supported by means of struts 26 or the like in the mast shaft 14 and/or one fixed by means of bracing or the like in the mast shaft 14 and/or one standing freely in the mast shaft must also be read.

In a particular embodiment, the struts 26—struts 26 in the area of the crown bearing and/or struts 26 along the entire mast structure 20—are automatically telescopic along their longitudinal axis. The automatic telescoping takes place, for example, by means of a control, which processes a signal from an inclination sensor (not shown) on the mast structure 20, in particular, an inclination sensor on that mast segment 60, from which the respective strut 26 extends.

An automatic telescoping is advantageous, when the surface of the mast shaft wall is assumed to be irregular. When such a strut 26 comes into contact with its free end with an inwardly bulging section of the mast shaft wall, the strut 26 with its current length presses the mast structure 20 to the side in a certain extent, so that it is inclined relative to the vertical. This inclination can be detected by means of the inclination sensor and a sensor signal encoding the resulting inclination can be used to automatically adjust the length of the strut 26. In the event of contact with an inwardly bulging section of the mast shaft wall, this control leads to a shortening of the length of the strut 26. The lateral pressure on the mast structure 20 due to the previously too long strut 26 for this section of the mast shaft 14 disappears.

For an outwardly bulging section of the mast shaft wall or in connection with a section of the mast shaft wall that previously bulged inward, the same applies accordingly in reverse. If the strut 26 loses contact with the mast shaft wall with such a bulge and this leads to an inclination of the mast structure 20, this inclination can also be detected by means of the inclination sensor and a corresponding signal can also be used here to adjust the length of the strut 26. Here, this control leads to an increase in the length of the strut 26. As soon as the strut 26, which was previously too short for this section of the mast shaft 14, is again in contact with the mast shaft wall, the strut 26 takes on the support function for the mast structure 20 again.

Optionally, such a control can also be superimposed with an automatic detection of a continuously existing contact of the free end of each strut 26 with the mast shaft wall. For this purpose, a roller mounted on the end of a strut 26, for example, resiliently, is connected to a sensor, for example, a sensing device, placed along the spring path. As long as the strut 26 with its roller is in contact with the mast shaft wall, the roller is slightly spring-deflected and the sensor delivers a signal, which encodes the contact of the roller with the mast shaft wall. As soon as the roller loses contact with the mast shaft wall, it springs outwards and the sensor signal disappears. When the sensor signal disappears, a telescoping of the strut 26 is automatically triggered to obtain a greater length of the strut 26 until the roller comes into contact with the mast shaft wall again and the sensor signal reappears.

Figure 6E:
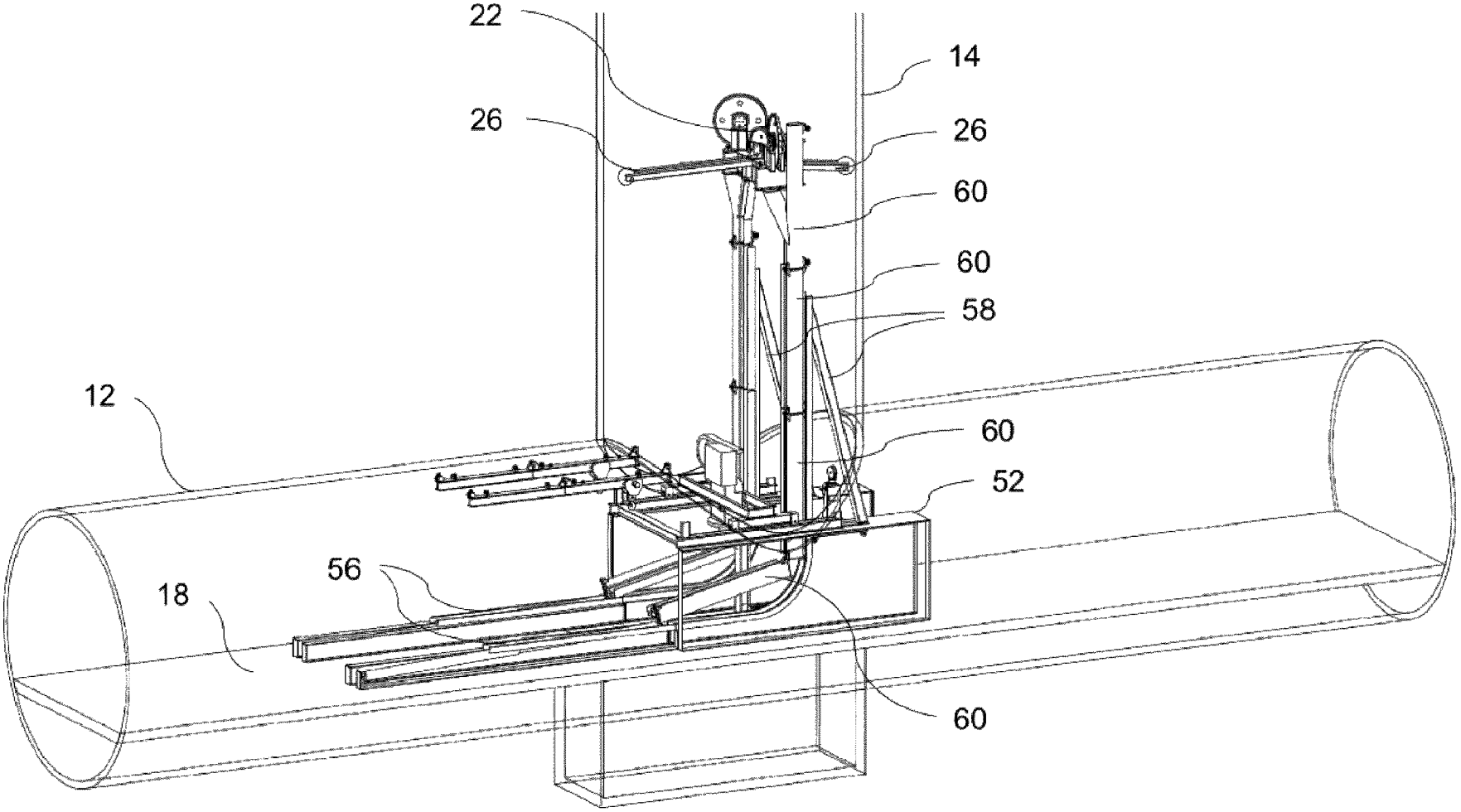
Figure 6F:
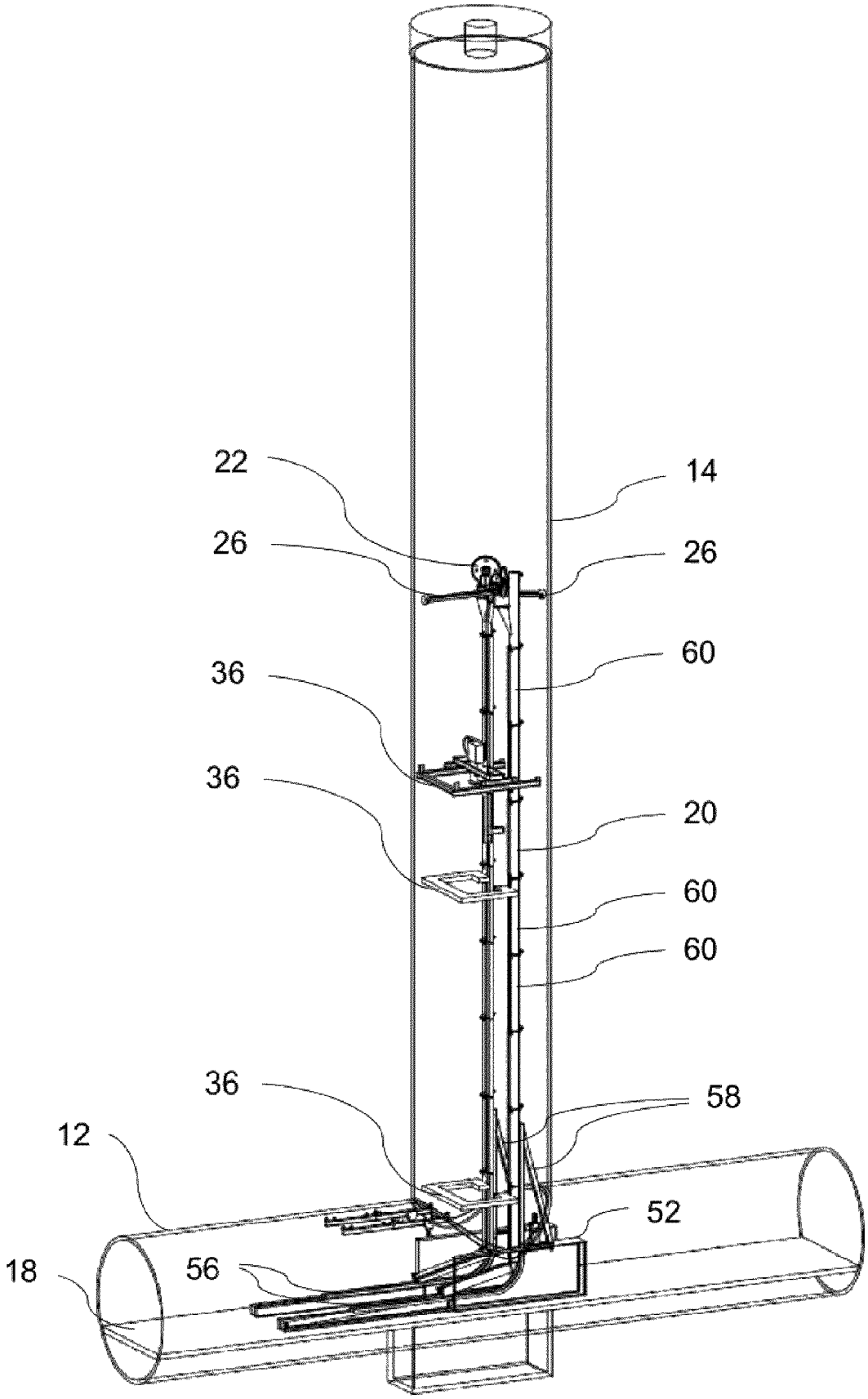
Figure 6G:
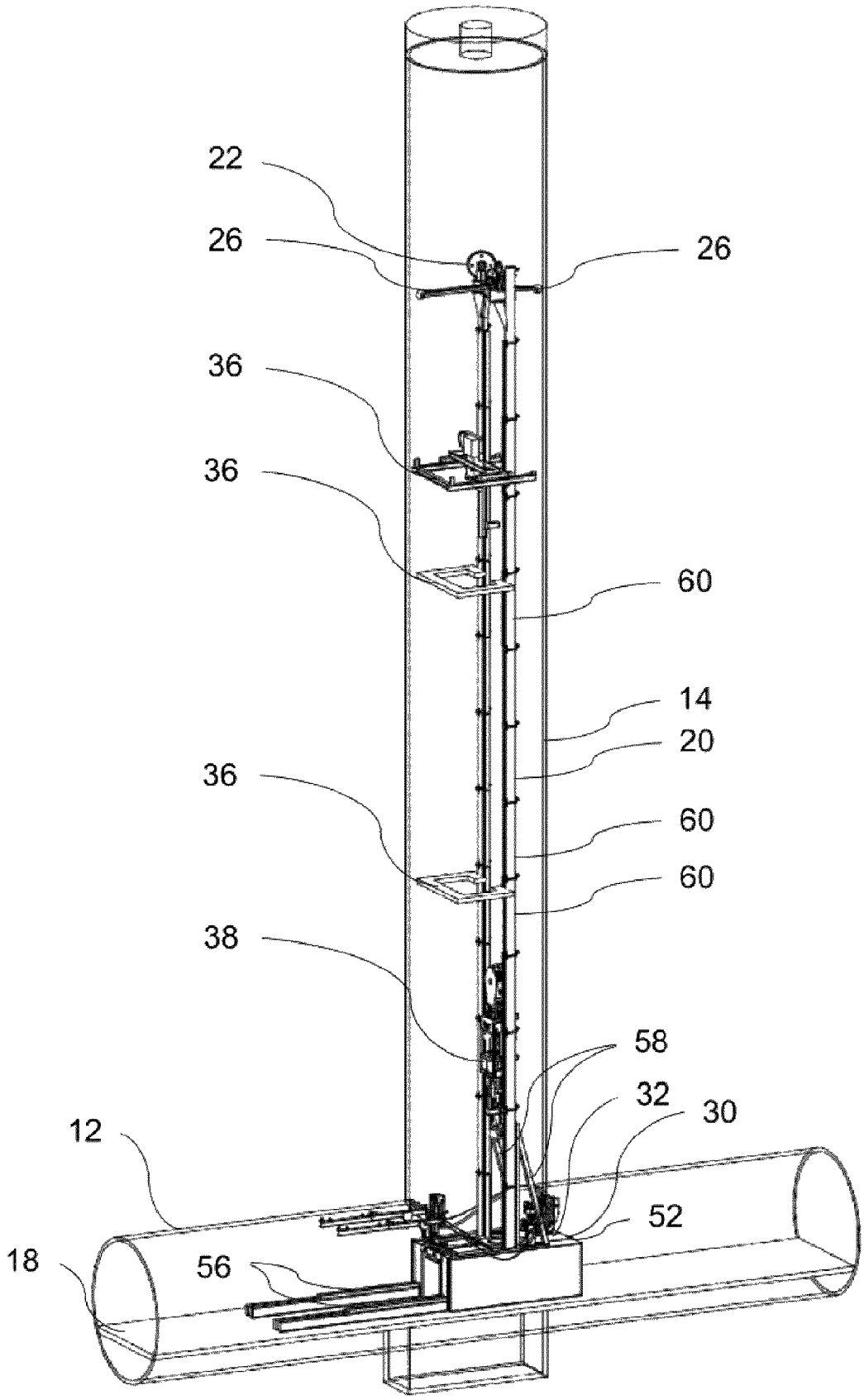

The illustrations in FIG. 6E, FIG. 6F and FIG. 6G show further snapshots during the erection of the mast structure 20 by means of the erecting structure 50 and into the mast shaft 14. The illustration in FIG. 6G shows a mast structure 20 with a height suitable for the drilling operation (a height adapted to the length of the drill pipe elements 34 provided for use during the drilling operation). This height is achieved in that when the mast structure 20 is erected by means of the erecting structure 50, in each case mast segments 60 are fed to said erecting structure on its input side, which push previously fed mast segments 60 in front of them in the erecting structure 50, so that originally horizontally fed mast segments 60 are erected by means of the erecting structure 50 in the area of its output side (are brought into an orientation aligned with the vertical axis of the mast shaft 14) and there leave the erecting structure 50 and erected mast segments 60 are raised into the mast shaft 14.

In the illustration in FIG. 6G, a top drive 38 is also already shown in the mast structure 20. This hangs in a manner that is in principle known per se on the pulley system extending from the crown bearing 22 and is guided by the mast structure 20 (function of the mast structure 20 as a torque support and function of the mast structure 20 for guiding and centering the top drive 38 over the borehole). For this purpose, the mast structure 20 is designed, for example, with opposing and facing profiles, for example, U-profiles. Rollers and/or sliding shoes or the like extending from the top drive 38 run in such profiles. The top drive 38 can thus be moved vertically along the mast structure 20 and in the profiles there (in a manner which is in principle known per se).

Specifically in the illustration in FIG. 6G (but also already in the illustrations in FIG. 3A, FIG. 3B, FIG. 6F), an upper end of the mast shaft 14 is shown as a disk. This disk constitutes—schematically simplified—a closure of the mast shaft 14 to the surface (a closure of the mast shaft to the area above ground). This disk is shown with an opening.

This opening constitutes—also schematically simplified—a ventilation shaft 16 (not designated in the figures mentioned; see, for example, FIG. 1). With reference to the mast shaft 14 which is closed or at least substantially closed to the area above ground, it becomes clear that the erection proposed here of an underground drilling rig 10 or the respective components of the underground drilling rig 10 takes place extending from a horizontal tunnel functioning as a production tunnel 12 into the (vertical) mast shaft 14, therefore "from bottom to top".

Figure 7:
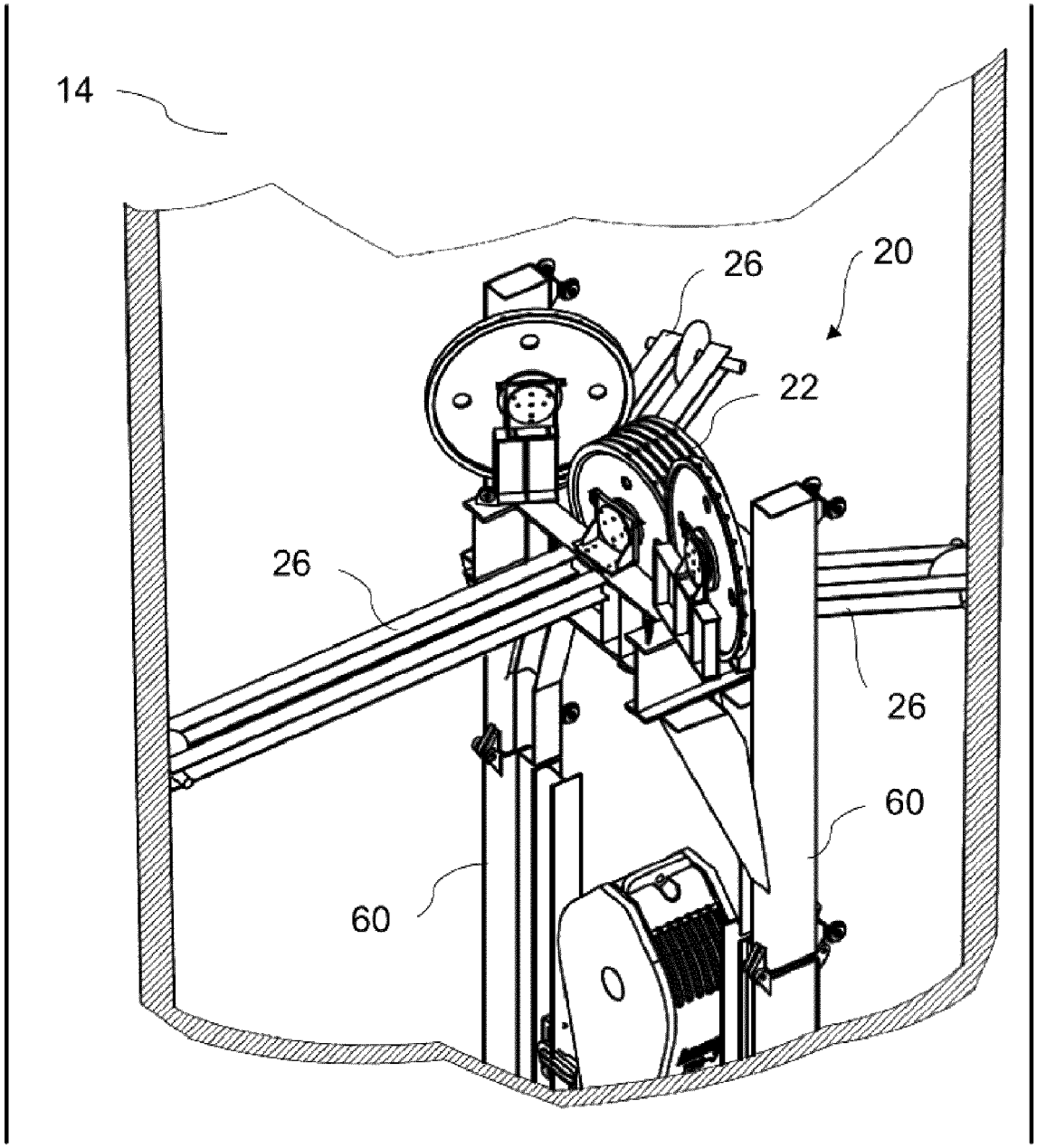
FIG. 7 shows an enlarged illustration of an upper mast segment of the mast structure.

The illustration in FIG. 7 shows in an enlargement the upper end of a mast structure 20 erected by means of the erecting structure 50 and according to the method as described above. A mast segment 60, here a mast segment 60 with the crown bearing 22, forms the upper end of the mast structure 20. Here a configuration with exactly three struts 26 is shown for supporting the mast structure 20 in the mast shaft 14 (during the drilling operation and previously when erecting the mast structure 20). One of these struts 26 is oriented on one side of the plane defined by the mast structure 20 transversely to said plane. Two struts 26 are located on the opposite side of the plane defined by the mast structure 20. These each enclose an angle with an imaginary plane, which is perpendicular to the plane defined by the mast structure 20 along the vertical axis of the mast structure 20. Both angles are the same or at least substantially the same and the distance measured from the starting point of the struts 26 from the mast segment 60 up to this plane is also the same or at least substantially the same for both struts 26. This results in a radial or at least substantially radial orientation of the struts 26 (this applies to the individual struts 26 as well as to the two struts 26) and with such a radial orientation a configuration comes into consideration with further struts 26, for example, on both sides in each case two struts 26, on both sides in each case three struts 26, one or two struts 26 on one side, three struts 26, etc. on the other side.

Individual aspects of the description submitted here that are in the foreground can thus be briefly summarized as follows: The invention relates to an underground drilling rig 10 (drilling rig 10 for deep drilling underground) and a method for its erection. During the erection, in one embodiment of the method, a crown bearing 22 of the drilling rig 10 is raised into a vertical shaft (mast shaft 14) extending from the installation site (production tunnel 12) (raised extending from the production tunnel 12 into the mast shaft 14; therefore, "from bottom to top"). This raising takes place either alone, in that only the crown bearing 22 is raised in the mast shaft 14, or in that the crown bearing 22 is raised by means of the mast structure 20 when a mast structure 20 of the drilling rig is being erected. To erect the mast structure 20, in one embodiment of the method, an erecting structure 50 is provided, which takes into account the fact that the mast structure 20 cannot be brought erect to the erection site of the drilling rig 10 in the production tunnel 12 and rather has to be assembled only on site (underground). The mast structure 20 is erected extending from the production tunnel 12 into the vertical mast shaft 14, therefore, "from bottom to top". In this respect, the invention also relates to this erection structure 50, a method for its operation, therefore a method for erecting a mast structure 20 of a drilling rig 10 into a vertical mast shaft 14 extending from the production tunnel 12 at the erection site of the drilling rig 10, and a mast structure 20 erected according to the method and a drilling rig 10 (underground drilling rig 10) with such a mast structure 20. The mast structure 20 can carry a crown bearing 22 and/or raise it. A drilling rig 10 with such a mast structure 20 and without a crown bearing 22 is also possible.

LIST OF REFERENCE SIGNS

10 underground drilling rig, drilling rig
12 production tunnel
14 mast shaft
16 ventilation shaft
18 floor level (production tunnel)
20 mast structure
22 crown bearing
24 drill string
26 strut
28 suspension (in the mast shaft)
30 substructure
32 drill floor
34 drill pipe element
36 finger board
38 top drive
40 hoisting apparatus
42 catwalk-machine
44 blow-out-preventer
50 erecting structure
52 erecting trestle
54 guide profile
56 horizontal section (of the guide profile/the erecting trestle)
58 vertical section (of the guide profile/the erecting trestle)
60 mast segment

The invention claimed is:

1. A method for erecting a drilling rig (10) for sinking boreholes on hydrocarbon deposits or for developing geothermal energy or other valuable materials or for research purposes, in a tunnel driven into a rock mass, which comprises a horizontal section functioning as a production tunnel (12) and production line, from which a vertical section extends as a mast shaft (14), characterized by the following method steps:

erecting a mast structure (20) in the mast shaft (14) by means of an erecting structure (50) in the production tunnel (12), wherein the mast structure (20) comprises a plurality of mast segments (60) connected to one another or connectable to one another, wherein successive mast segments (60) are fed to the erecting structure (50) on an input side of the erecting structure (50) in a horizontal or at least substantially horizontal orientation, wherein by means of the erecting structure (50) in each case at least one mast segment (60) on an output side of the erecting structure (50) is erected in a vertical or at least substantially vertical orientation into the mast shaft (14) or at least pointing into the mast shaft (14), and wherein while feeding further mast segments (60) on the input side of the erecting structure (50) the or each mast segment (60) already vertically erected on the output side of the erecting structure (50) is raised into the mast shaft (14).

2. The method according to claim 1, wherein the erecting structure (50) comprises two erecting trestles (52) arranged at a distance from one another and parallel to one another and wherein each erecting trestle (52) carries a guide profile (54) for the mast segments (60), wherein a first section (56) of the guide profile (54) is oriented horizontally or at least substantially horizontally at a first end of the erecting trestles (52), wherein a second section (58) of the guide profile (54) is oriented vertically or at least substantially vertically at a second end of the erecting trestles (52) opposite the first end, wherein the vertical or at least substantially vertical sections (58) of the guide profiles (54) below the mast shaft (14) point into the mast shaft (14), wherein in each case a mast segment (60) of the erecting structure (50) is transferred in the area of the first section (56) of the guide profiles (54) and guided in the guide profiles (54) and wherein the transferred mast segment (60) is moved along the guide profiles (54) and is erected in the area of the second sections (58) of the guide profiles (54) by means of the second sections (58) of the guide profiles (54).

3. The method according to claim 2, wherein the mast segments (60) are connected to one another in an articulated manner.

4. The method according to claim 1, wherein the erection of the mast structure (20) in the mast shaft (14) occurs by means of the erecting structure (50), by in each case at least one mast segment (60) in the erecting structure (50) being pulled or pushed in the horizontal or at least substantially horizontal direction and/or raised in the vertical or at least substantially vertical direction.

5. The method according to claim 1, wherein a crown bearing (22) is raised in the mast shaft (14) by means of the mast structure (20).

6. The method according to claim 5, wherein the crown bearing (22) is fixed in the mast shaft (14) transversely to a vertical axis of the mast shaft (14), and wherein this fixation takes place by means of at least one strut (26) functioning as a crown bearing fixing strut, which extends from the crown bearing (22) to a wall of the mast shaft (14).

7. The method according to claim 1, wherein a crown bearing (22) is raised by means of a lifting device in the mast shaft (14).

8. The method according to claim 7, wherein the crown bearing (22) is fixed in the mast shaft (14) transversely to a vertical axis of the mast shaft (14) in the mast shaft (14), and wherein this fixation takes place by means of at least one strut (26) functioning as a crown bearing fixing strut, which extends from the crown bearing (22) to a wall of the mast shaft (14).

9. The method according to claim 1, wherein the mast segments (60) are connected to one another in an articulated manner.

10. An apparatus for erecting a drilling rig (10) for sinking boreholes on hydrocarbon deposits or for developing geothermal energy or other valuable materials or for research purposes, in a tunnel driven into a rock mass, which comprises a horizontal section functioning as a production tunnel (12) and production line, from which a vertical section extends as a mast shaft (14), wherein the apparatus comprises an erecting structure (50) for erecting a mast structure (20) of the drilling rig (10), wherein the mast structure (20) comprises a plurality of mast segments (60) connected to one another or connectable to one another, wherein the erecting structure (50) is configured to: (a) receive at least one mast segment (60) being fed to an input side of the erecting structure (50) in a horizontal orientation, (b) guide said at least on mast segment through the erecting structure (50) or along the erecting structure (50) up to an output side of the erecting structure (50), and (c) erect said at least one segment in the area of the output side and brought into a vertical orientation.

11. The apparatus according to claim 10, wherein a mast segment (60) guided through the erecting structure (50) or along the erecting structure (50) pushes in front of it each mast segment (60) previously fed to the erecting structure (50) through the erecting structure (50) or along the erecting structure (50).

12. The apparatus according to claim 11, wherein each mast segment (60) already erected by the erecting structure (50) is raised into the mast shaft (14) by means of another mast segment (60) when said another mast segment is erected by means of the erecting structure (50).

13. The apparatus according to claim 12, wherein the erecting structure (50) comprises two erecting trestles (52) arranged at a distance from one another and parallel to one another and wherein each erecting trestle (52) carries a guide profile (54), wherein a first section (56) of the guide profile (54) is oriented horizontally or at least substantially horizontally at a first end of the erecting trestles (52), wherein a second section (58) of the guide profile (54) is oriented vertically or at least substantially vertically at a second end of the erecting trestles (52) opposite the first end, wherein the vertical or at least substantially vertical sections (58) of the guide profiles (54) below the mast shaft (14) point into the mast shaft (14).

14. A mast structure (20) of a drilling rig (10) for sinking boreholes on hydrocarbon deposits and for developing geothermal energy or other valuable materials or for research purposes, in a tunnel driven into a rock mass, which comprises a horizontal section functioning as a production tunnel (12) and production line, from which a vertical section extends as a mast shaft (14), wherein the mast structure (20) is erected by means of a method according to claim 2.

15. A drilling rig (10) for sinking boreholes on hydrocarbon deposits and for developing geothermal energy or other valuable materials or for research purposes, in a tunnel driven into a rock mass, which comprises a horizontal section functioning as a production tunnel (12) and production line, from which a vertical section extends as a mast shaft (14), and having a mast structure (20) according to claim 14.

16. A mast structure (20) of a drilling rig (10) for sinking boreholes on hydrocarbon deposits and for developing geothermal energy or other valuable materials or for research purposes, in a tunnel driven into a rock mass, which comprises a horizontal section functioning as a production tunnel (12) and production line, from which a vertical section extends as a mast shaft (14), wherein the mast structure (20) is erected by means of an apparatus according to claim 10.

17. A drilling rig (10) for sinking boreholes on hydrocarbon deposits and for developing geothermal energy or other valuable materials or for research purposes, in a tunnel driven into a rock mass, which comprises a horizontal section functioning as a production tunnel (12) and production line, from which a vertical section extends as a mast shaft (14), and having a mast structure (20) according to claim 16.

* * * * *